US006463863B1

(12) United States Patent
Ishikawa et al.

(10) Patent No.: US 6,463,863 B1
(45) Date of Patent: Oct. 15, 2002

(54) COMMODITY CARRYING AND STORING APPARATUS

(75) Inventors: Sakae Ishikawa; Tomoaki Arai; Satoshi Ishihara; Isamu Tanaka, all of Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/611,661

(22) Filed: Jul. 6, 2000

(30) Foreign Application Priority Data

Jul. 7, 1999 (JP) ..... 11-192636

(51) Int. Cl.[7] ..... B65D 19/38
(52) U.S. Cl. ..... 108/53.1; 108/55.1
(58) Field of Search ..... 108/55.1, 55.3, 108/55.5, 53.1, 53.3, 53.5; 211/191, 192, 194, 202, 206

(56) References Cited

U.S. PATENT DOCUMENTS

| | | | | |
|---|---|---|---|---|
| 1,736,172 A | * | 11/1929 | Raymond | |
| 1,738,516 A | * | 12/1929 | Bloom | |
| 2,577,276 A | * | 12/1951 | Saul, Jr. | |
| 2,937,767 A | * | 5/1960 | Butler et al. | |
| 3,009,582 A | * | 11/1961 | Degener | |
| 3,405,665 A | * | 10/1968 | Slonim | |
| 3,753,407 A | * | 8/1973 | Tilseth | 108/53.3 |
| 4,545,710 A | * | 10/1985 | Hepp | 108/53.1 X |
| 4,673,092 A | * | 6/1987 | Lamson et al. | 108/53.1 X |
| 4,703,702 A | | 11/1987 | Speicher | |
| 5,413,054 A | * | 5/1995 | Collins | 108/55.3 |
| 5,651,463 A | * | 7/1997 | Major et al. | 108/53.3 X |
| 5,694,638 A | | 12/1997 | Maruyama et al. | |
| 5,722,328 A | * | 3/1998 | Darby | 108/55.1 |
| 6,286,792 B1 | * | 9/2001 | Best | 108/53.1 X |

FOREIGN PATENT DOCUMENTS

| | | |
|---|---|---|
| DE | 914 237 | 6/1954 |
| DE | 41 16 171 | 11/1992 |
| GB | 2 045 721 | 11/1980 |
| GB | 2 189 773 | 11/1987 |
| GB | 2 257 422 | 1/1993 |
| GB | 2 349 135 | 10/2000 |
| JP | 11-062447 | 3/1999 |
| JP | 11-208663 | 8/1999 |

* cited by examiner

*Primary Examiner*—Jose V. Chen
(74) *Attorney, Agent, or Firm*—Oblon, Spivak, McClelland, Maier & Neustadt, P.C.

(57) ABSTRACT

First and second coupling members are provided between neighboring two columns so that the distance between neighboring columns detachably attached to the four corners of a pallet on which a commodity is placed can be freely changed. Guiding members for guiding an upper commodity carrying and storing apparatus when the upper commodity carrying and storing apparatus is stacked on a lower commodity carrying and storing apparatus are provided on a top plate.

28 Claims, 19 Drawing Sheets

COMMODITY CARRYING AND STORING APPARATUS

FIELD OF THE INVENTION

The present invention relates to a commodity carrying and storing apparatus comprising, a pallet on which a commodity is placed, a plurality of columns detachably attached to the pallet in positions so as to surround the commodity placed on the pallet, coupling means for coupling neighboring two columns while adjusting the distance between the two columns, and a top plate which is detachably attached to the top of each of the plurality of columns directly or via another member.

BACKGROUND OF THE INVENTION

A commodity carrying and storing apparatus used to carry or store various industrial products such as electrical products, parts of the industrial products, construction materials, furniture, natural goods, and other various commodities is conventionally known. A conventional commodity carrying and storing apparatus of this kind generally comprises: a pallet on which a commodity is placed; four columns fixed at four corners of the pallet in a state where the columns are upright on a commodity placement face of the pallet; and coupling members each for fixedly coupling neighboring columns. In the case of carrying a commodity by the commodity carrying and storing apparatus, a commodity is housed in a space on the inside of the four columns and is placed on the pallet. The commodity carrying and storing apparatus having therein the commodity is carried. In the case of storing the commodity housed in the commodity carrying and storing apparatus into a warehouse or the like, a plurality of commodity carrying and storing apparatuses can be stacked, so that the space in the warehouse can be effectively utilized.

The sizes of commodities to be carried or stored by the commodity carrying and storing apparatuses of this kind are various. On the other hand, in the conventional commodity carrying and storing apparatus, the volume of the space for housing a commodity is fixed. Consequently, although a commodity in a size adapted to the commodity carrying and storing apparatus of a specific size can be carried or stored, a commodity of a size larger than the commodity housing space of the commodity carrying and storing apparatus cannot be carried or stored. In the case of carrying or storing a commodity extremely smaller than the commodity housing space by the commodity carrying and storing apparatus, it is unpreferable since the carrying efficiency deteriorates and, moreover, the space in the warehouse is vainly used.

The applicant of the invention has therefore proposed the above-described commodity carrying and storing apparatus (Japanese Patent Application No. 11-62447). According to the commodity carrying and storing apparatus, the distance between neighboring columns can be adjusted, so that commodities of various sizes can be efficiently carried or stored. Moreover, other commodities can be placed on the top plate.

Only with the construction which has been proposed, however, when the commodity carrying and storing apparatuses are stacked, a work of accurately placing the upper commodity carrying and storing apparatus onto the lower commodity carrying and storing apparatus is not easy. It is feared that the work efficiency deteriorates.

SUMMARY OF THE INVENTION

It is an object of the invention to provide a commodity carrying and storing apparatus obtained by eliminating the drawbacks from the above-described conventional commodity carrying and storing apparatus.

According to the invention, in order to achieve the object, there is proposed a commodity carrying and storing apparatus wherein the top plate is provided with guiding means for guiding an upper commodity carrying and storing apparatus to a predetermined placement position in a lower commodity carrying and storing apparatus when the upper and lower commodity carrying and storing apparatuses are stacked.

In this case, it is advantageous when the guiding means also serves as apparatus positioning means for positioning the upper commodity carrying and storing apparatus to the lower commodity carrying and storing apparatus when the upper commodity carrying and storing apparatus is placed on the lower commodity carrying and storing apparatus.

Preferably, in the commodity carrying and storing apparatus according to a first aspect or a second aspect, the guiding means has a guide face for guiding the upper commodity carrying and storing apparatus in one of horizontal directions when the upper commodity carrying and storing apparatus is lowered from above the lower commodity carrying and storing apparatus and is placed on the lower commodity carrying and storing apparatus.

Preferably, in the commodity carrying and storing apparatus according to a third aspect, the guiding means has a guide face for guiding the upper commodity carrying and storing apparatus in the other horizontal direction which is orthogonal to the one of the horizontal directions when the upper commodity carrying and storing apparatus is lowered from above the lower commodity carrying and storing apparatus and is placed on the lower carrying and storing apparatus.

In the commodity carrying and storing apparatus according to the third aspect or a forth aspect, it is advantageous when the guide face is constructed as an inclined face for guiding the pallet of the upper commodity carrying and storing apparatus.

Preferably, in the commodity carrying and storing apparatus according to any one of the first aspect to a fifth aspect, the commodity carrying and storing apparatus further comprises top plate positioning means for positioning the top plate to the pallet so as to construct a top plate and pallet assembly in which the top plate and the pallet are assembled when the top plate is detached from the columns, the columns are detached from the pallet, and the top plate is placed on the pallet.

In the commodity carrying and storing apparatus according to a sixth aspect, the top plate positioning means may be comprised of a projection provided for the pallet and a hole which is formed in the top plate to be placed on the pallet and in which the projection is fit.

Preferably, in the commodity carrying and storing apparatus according to any one of the first aspect to a seventh aspect, when the top plate is detached from the columns, the columns are detached from the pallet, the top plate is placed on the pallet, the top plate and the pallet are assembled as a top plate and pallet assembly, and upper and lower top plate and pallet assemblies are stacked, the guiding means guides the upper top plate and pallet assembly to the lower top plate and pallet assembly.

In the commodity carrying and storing apparatus according to any one of the first aspect to an eighth aspect, when an upper top plate and pallet assembly is placed on a lower top plate and pallet assembly, the guiding means may position the upper top plate and pallet assembly to the lower top plate and pallet assembly.

In the commodity carrying and storing apparatus according to any one of the sixth aspect to a ninth aspect, it is advantageous that the plurality of columns and coupling means construct a column unit which can be folded in a state where the columns are detached from the pallet, and openings are formed in the pallet and the top plate so that when a plurality of top plate and pallet assemblies are stacked, a space for storing the folded column unit is formed on the inside.

Preferably, in the commodity carrying and storing apparatus according to a tenth aspect, a part of the column unit is formed larger than the opening formed in the top plate, and the largely formed part in the column unit can be engaged with the periphery of the opening formed in the top plate.

Further, in the commodity carrying and storing apparatus according to an eleventh aspect, it is advantageous that the pallet is constructed so that a space in which a cargo gear is inserted is formed below a commodity placement face, a plurality of openings are formed in the top plate, and the length of the column unit is set so that the column unit does not exist in the space below the commodity placement face of the pallet in the lowest top plate and pallet assembly when top plate and pallet assemblies of the number equal to the number of openings are stacked and the column unit is inserted to each of the openings formed in the top plate of the uppermost top plate and pallet assembly.

Preferably, in the commodity carrying and storing apparatus according to any one of the first aspect to a twelfth aspect, a display part in which desired information is written is provided for the top plate.

In the commodity carrying and storing apparatus according to a thirteenth aspect, the display part may be a tongue part which extends downward from the periphery of the top plate.

In the commodity carrying and storing apparatus according to any one of the first aspect to a fourteenth aspect, it is advantageous that four columns detachably attached to the pallet so as to be almost perpendicular to a commodity placement face of the pallet are provided, and the coupling means interlockingly adjusts the distances so that distances each between two neighboring columns change at the same ratio.

Preferably, in the commodity carrying and storing apparatus according to any one of the first aspect to the fourteenth aspect, four columns detachably attached to the pallet so as to be almost perpendicular to a commodity placement face of the pallet are provided, and the coupling means interlockingly adjusts a distance between two neighboring columns and a distance between other two neighboring columns which face the above two columns so that the distances change at the same ratio.

Preferably, in the commodity carrying and storing apparatus according to any one of the first aspect to a fifth aspect, four columns which are detachably attached to the pallet so as to be almost perpendicularly to a commodity placement face of the pallet are provided, the coupling means has first and second joints attached to each column along the longitudinal direction of the column and first and second coupling members for coupling two neighboring columns to each other, the second joint is positioned lower than the first joint in a state where the four columns are attached to the pallet, the first and second coupling members are positioned so as to cross each other in a state where the four columns are attached to the pallet, one end in the longitudinal direction of each of the first coupling members is turnably coupled to the first joint attached to one of neighboring columns, the other end in the longitudinal direction is turnably coupled to the second joint attached to the other column in the two neighboring columns, one end in the longitudinal direction of each of the second coupling members is turnably coupled to the first joint attached to the other column, the other end in the longitudinal direction is turnably coupled to the second joint attached to the one of the columns, and at least one of the first and second joints is assembled to each of the columns so as to be movable in the longitudinal direction of the column.

Preferably, in the commodity carrying and storing apparatus according to any one of the fourteenth aspect to a sixteenth aspect, first to fourth columns detachably attached to the pallet almost so as to be perpendicular to a commodity placement face of the pallet are provided; the coupling means has first to third joints attached to each of first to fourth columns along the longitudinal direction of the column and first and second coupling members for coupling neighboring first and second columns, neighboring second and third columns, neighboring third and fourth columns, and neighboring fourth and first columns; the second and third joints are positioned lower than the first joint and the second joint is positioned lower than the third joint in a state where the four columns are attached to the pallet; the first and second coupling members are positioned so as to cross each other in a state where the four columns are attached to the pallet; one end in the longitudinal direction of each of the first and second coupling members provided between the first and second neighboring columns and the first and second coupling members provided between the third and fourth columns positioned opposite to the first and second columns is turnably coupled to the first joint attached to each of the first to fourth columns, and the other end in the longitudinal direction is turnably coupled to the second joint attached to each of the first to fourth columns; one end in the longitudinal direction of each of the first and second coupling members provided between the neighboring second and third columns and the first and second coupling members provided between the fourth and first columns which are positioned opposite to the second and third columns is turnably coupled to the first joint attached to each of the second, third, fourth and first columns, and the other end in the longitudinal direction is turnably coupled to the third joint attached to each of the second, third, fourth and first columns; and at least the second and third joints in the first to third joints are assembled to each of the columns so as to be movable in the longitudinal direction of the column.

Other objects and features of this invention will become understood from the following description with reference to the accompanying drawings.

BRIEF DESCRIPTION OF THE INVENTION

DESCRIPTION OF THE PREFERRED EMBODIMENT

Embodiments of the invention will be described in detail hereinbelow. First, the basic construction of a commodity carrying and storing apparatus will be disclosed.

Figure 1:
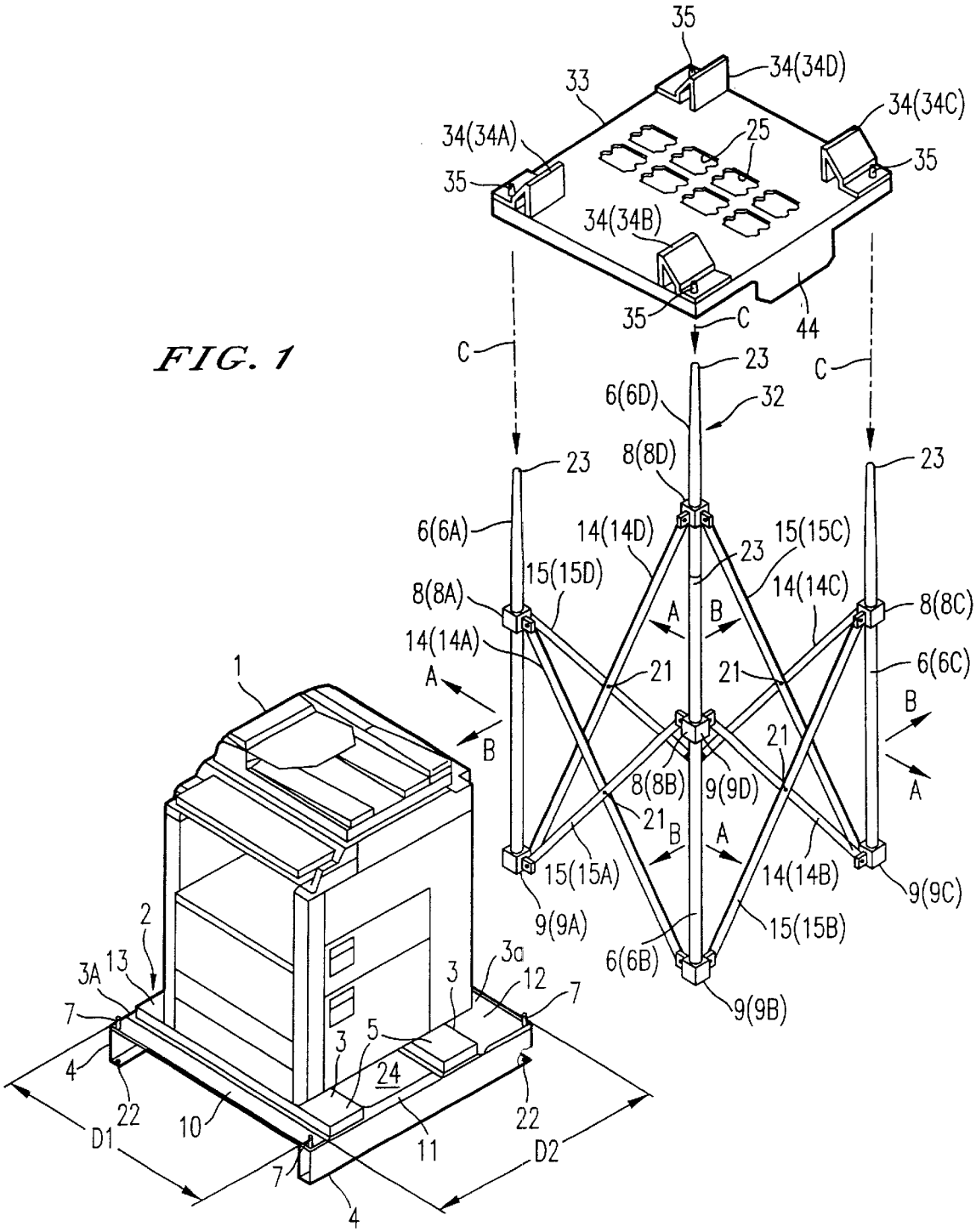
FIG. 1 is a perspective view showing an example of a commodity carrying and storing apparatus.

FIG. 1 is a perspective view showing an example of a commodity carrying and storing apparatus according to the invention. The commodity carrying and storing apparatus has a pallet 2 on which a commodity 1, for example, a copying machine is placed. The pallet 2 shown as an example has: two legs 4 which are hollow members extending in parallel with each other; two seating members 3 fixed to the legs 4 in a state where the seating members 3 are spanned across the legs 4; and two reinforcing members 3A also fixed to the legs 4. The top face of each of the seating members 3 serves as a commodity placement face 5 on which the commodity 1 is placed. The shape in plan view of the pallet 2 is almost a rectangle. The pallet 2 is formed by a plate made of a metal such as steel. The pallet 2 can be also made of a very rigid material such as wood or hard resin. The seating members 3, the reinforcing members 3A and the legs 4 may be fixedly adhered by welding, an adhesive or the like or may be fixed by screws (not shown) or the like so as to be easily disassembled. A pallet obtained by fixing a proper number of legs to the bottom face of a rectangular flat plate member or pallets of other forms can be also used. Further, the shape in plan view of a pallet is not limited to rectangle but can be oval or circle.

The commodity 1 placed on the commodity placement face 5 of the pallet 2 is positioned to the pallet 2 by commodity positioning means (not shown) constructed by, for instance, a pin protruded on the commodity 1 side and a hole which is formed in the pallet 2 and in which the pin on the commodity 1 side is fit. The commodity 1 is fixed on the pallet 2 so as to be easily detached by commodity fixing means constructed by, for example, a bolt and a nut.

Figure 2:
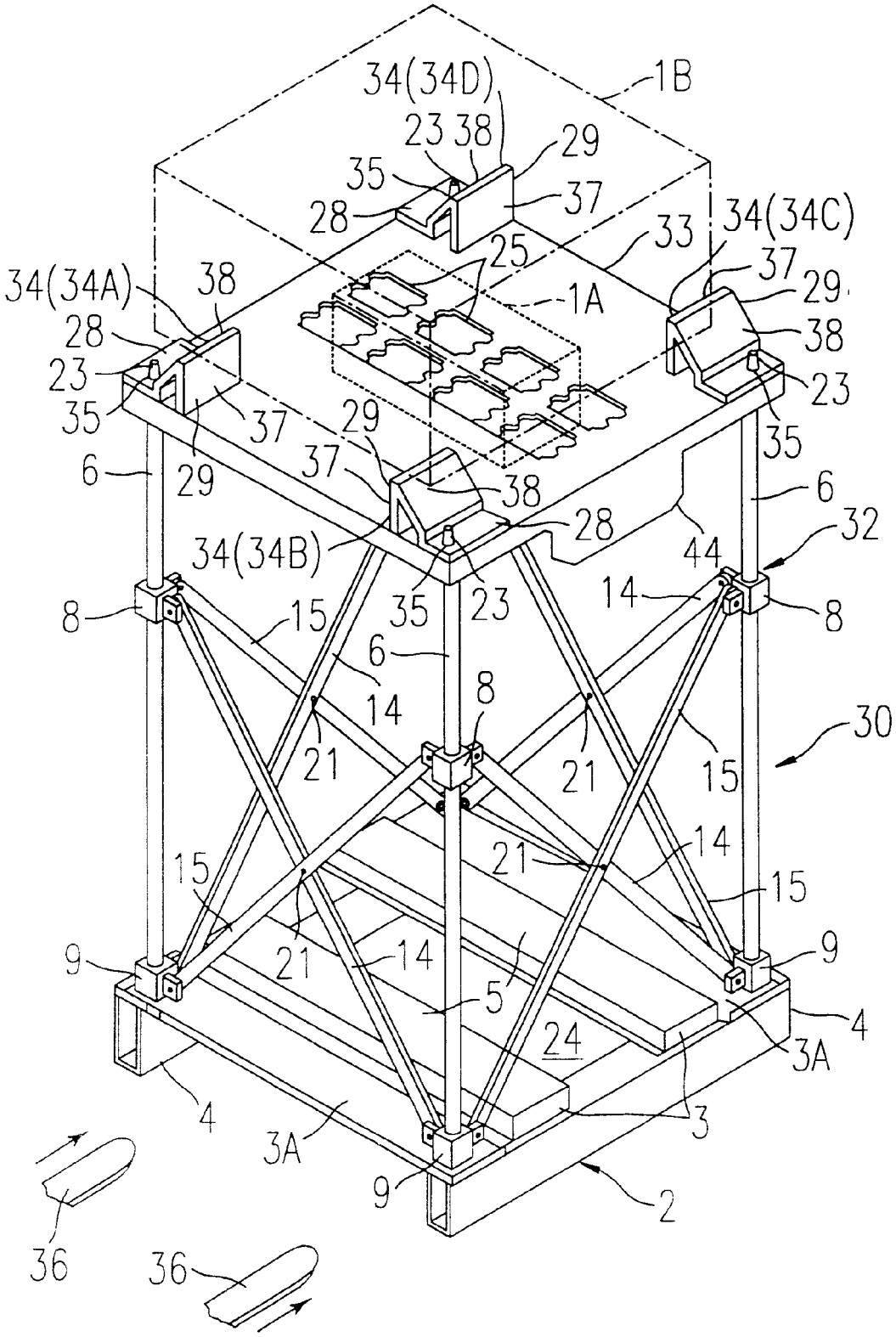
FIG. 2 is a perspective view showing a state where the commodity carrying and storing apparatus illustrated in FIG. 1 is assembled.
Figure 3:
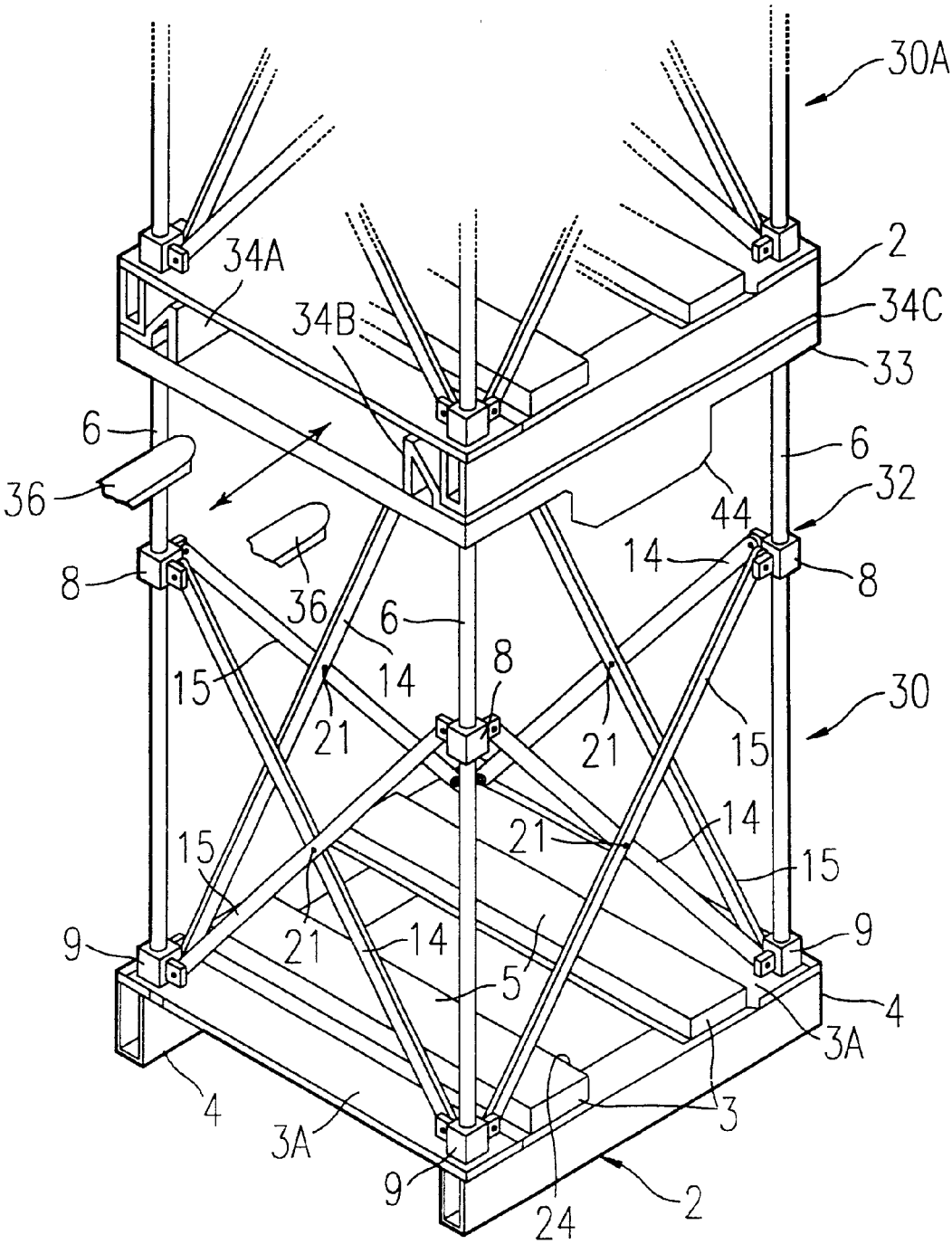
FIG. 3 is a perspective view showing a state where the commodity carrying and storing apparatuses illustrated in FIG. 1 are assembled and stacked.
Figure 4:
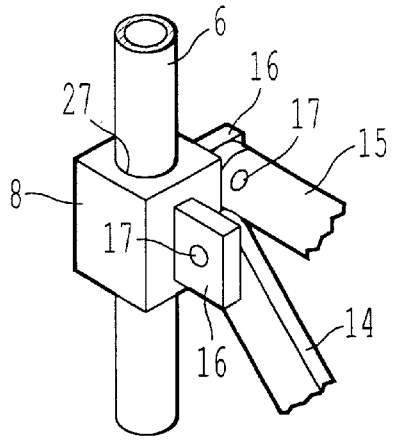
FIG. 4 is an enlarged perspective view of a first joint shown in FIG. 1 and a coupling member coupled to the first joint.
Figure 5:
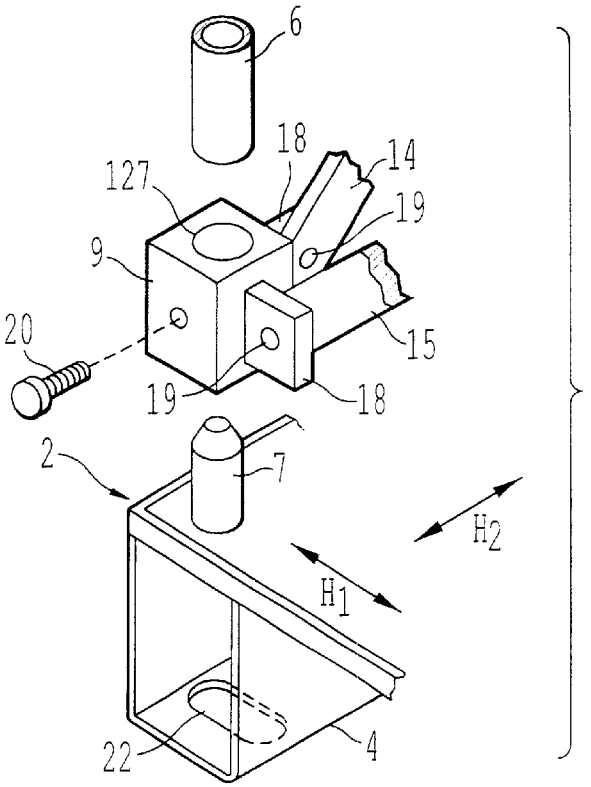
FIG. 5 is an exploded perspective view showing a state where a column is separated from a second joint illustrated in FIG. 1.

The commodity carrying and storing apparatus has a plurality of columns, that is, four columns in the example of FIG. 1. As shown in FIGS. 2 and 3, the columns 6 are detachably attached at the four corners of the pallet 2 so as to be upright and almost perpendicular to the commodity placement face 5 of the pallet 2. When a rectangle is imagined on the pallet 2, the columns 6 are detachably provided upright in the pallet corresponding to the corners of the imaginary rectangle. The columns 6 are made of metal, resin or wood. In the example shown in the drawing, as also shown in FIGS. 4 and 5, each of the columns 6 is constructed by a hollow pipe made of a metal. Projections 7 made by pins fixed to the legs 4 or reinforcing members 3A are provided so as to project at the four corners on the commodity placement face 5 of the pallet 2. The lower part of each of the columns 6 is detachably fit around each of the projections 7. In such a manner, the plurality of columns 6 are detachably attached to the pallet 2 in positions so as to surround the commodity 1 placed on the commodity placement face 5 of the pallet 2. The columns 6 of the embodiment are attached to the pallet 2 so as to be easily detached manually.

The commodity carrying and storing apparatus has also coupling means each for coupling two neighboring columns while adjusting the distance between the neighboring columns. The coupling means of the embodiment has: first and second joints 8 and 9 attached to each of the columns 6 along the longitudinal direction; and a pair of coupling members for coupling neighboring two neighboring columns 6, that is, first and second coupling members 14 and 15. Each of the first and second coupling members 14 and 15 couples two neighboring columns 6 which are attached in each of the sides of the pallet 2, that is, first to fourth sides 10, 11, 12 and 13 which are orthogonal to each other. As understood from FIGS. 2 and 3, in a state where the four columns 6 are attached to the pallet 2, the second joint 9 is positioned lower than the first joint 8. Similarly, in a state where the four columns 6 are attached to the pallet 2, the first and second coupling members 14 and 15 are positioned so as to cross each other.

As shown in FIGS. 4 and 5, each of the first and second joints 8 and 9 is a cylindrical member molded by using, for example, metal, synthetic resin or rubber. Each of the columns 6 is fit in each of center holes 27 and 127 of the first and second joints 8 and 9, respectively. Two tongue pieces 16 are provided so as to project from the joint 8 and two tongue pieces 18 are provided so as to project from the joint 9. An end in the longitudinal direction of the first coupling member 14 is turnably coupled to the tongue piece 16 via a pin 17. An end in the longitudinal direction of the second coupling member 15 is turnably coupled to the tongue piece 18 via a pin 19. Each of the first and second coupling members 14 and 15 is constructed by a rigid member made of, for example, wood, hard resin or metal and is formed in a stick shape or a narrow plate shape.

When it is necessary to identify the four columns 6, as shown in FIG. 1, the columns 6 are called a first column 6A, a second column 6B, a third column 6C and a fourth column 6D. Similarly, the first and second joints 8 and 9 attached to the columns 6A to 6D are designated by reference numerals 8A, 9A; 8B, 9B; 8C, 9C; and 8D, 9D so as to be discriminated from each other. Similarly, the first and second coupling members for coupling the first and second columns 6A and 6B, the second and third columns 6B and 6C, the third and fourth columns 6C and 6D, and the fourth and first columns 6D and 6A are designated by reference numerals 14A, 15A; 14B, 15B; 14C, 15C; and 14D, 15D so as to be discriminated from each other. The components are similarly designated by the reference numerals also in the following embodiment.

The first and second coupling members 14 and 15 are swingably coupled to the joint as follows.

As understood from FIGS. 1 to 3, one end in the longitudinal direction of the first coupling member 14A provided between the first and second columns 6A and 6B which are attached adjacent to each other in the first side 10 of the pallet 2 is turnably coupled via the pin 17 (FIG. 4) to the first joint 8A attached to the first column 6A as one of the columns. The other end in the longitudinal direction is turnably coupled via a pin to the second joint 9B attached to the second column 6B as the other column. One end in the longitudinal direction of the second coupling member 15A provided between the first and second columns 6A and 6B is turnably coupled via a pin to the first joint 8B attached to the second column 6B as the other column. The other end in the longitudinal direction is turnably coupled via a pin to the second joint 9A attached to the first column 6A as the one of the columns. The relations are quite similar with respect to: the first and second coupling members 14B and 15B provided between the second and third columns 6B and 6C which are attached so as to be adjacent to each other in the second side 11 next to the first side 10 of the pallet 2; the first and second coupling members 14C and 15C provided between the third and fourth columns 6C and 6D attached so as to be adjacent to each other in the third side 12 next to the second side 11; and further the first and second coupling members 14D and 15D provided between the fourth and first columns 6D and 6A attached so as to be adjacent to each other in the fourth side 13 next to the third side 12.

As described above, in the commodity carrying and storing apparatus shown in FIGS. 1 to 3, one end in the longitudinal direction of each of the first coupling members 14 is turnably coupled to the first joint 8 attached to one of two columns 6 which are adjacent to each other in each of the sides 10, 11, 12 and 13 of the pallet 2. The other end in the longitudinal direction is turnably coupled to the second joint 9 attached to the other column 6 in the two neighboring columns 6. One end in the longitudinal direction of the second coupling member 15 is turnably coupled to the first joint 8 attached to the other column 6 and the other end in the longitudinal direction is turnably coupled to the second joint 9 attached to the one of the columns 6. As described above, each of the columns 6 functions as a column for supporting the first and second coupling members 14 and 15.

At least one of the first and second joints 8 and 9 coupled as described above to the first and second coupling members 14 and 15 is assembled so as to be freely movable in the longitudinal direction of each of the columns 6 to which the first and second joints 8 and 9 are attached. In the example shown in the diagram, each of the second joints 9 is positioned lower than each of the columns 6 and is fixed to each of the columns 6 by a screw 20 as shown in FIG. 5, welding, or the like. Moreover, each of the first joints 8 is fit to each of the columns 6 so as to be slidable in the longitudinal direction of the column 6. It is also possible to fix the first joint 8 to the column 6 and slidably fit the second joint 9 to the column 6 or slidably fit the first and second joints 8 and 9 to the column 6.

The pallets 2 shown in FIG. 1 in various sizes adapted to the sizes of the commodities 1 to be carried are prepared. When a commodity 1 is carried, the pallet 2 adapted to the size of the commodity 1 is selected and the commodity 1 is placed on the commodity placement face 5 as the top face of the pallet 2. In this event, the distances D1 and D2 between the projections 7 vary according to the size of the selected pallet 2. The distance between neighboring columns 6 which are not yet attached to the pallet 2 can be freely adjusted as follows so as to coincide with the distances D1 and D2.

Specifically, when the two neighboring columns 6A and 6B among the columns 6 which are not yet attached to the pallet 2 and the two columns 6C and 6D opposite to the columns 6A and 6B are pressed in the directions shown by the arrows A in FIG. 1 so as to make them apart from each other, each of the first joints 8 slides downward along the column 6 so that the distance between the first and second columns 6A and 6B and the distance between the third and fourth columns 6C and 6D are widened. Simultaneously, the first and fourth columns 6A and 6D and the second and third columns 6B and 6C are moved so as to be apart from each other as shown by the arrows B. Consequently, the distance between the columns 6A and 6D and the distance between the columns 6B and 6C are also widened.

On the contrary, when a force is applied to the columns 6 in the directions opposite to the arrows A and B, each of the first joints 8 moves upward along each of the columns 6, so that the distance between the neighboring columns is narrowed. In the example shown in FIG. 1, the distances are interlockingly adjusted so that the distances each between neighboring two columns in each of the sides 10, 11, 12 and 13 of the pallet 2 change at the same ratio. That is, the coupling means for coupling two columns is constructed to interlockingly adjust the distances so that all of the distances each between two neighboring columns change at the same ratio.

After adjusting the distance between the neighboring columns 6 in accordance with the distances D1 and D2 each between the projections 7 of the selected pallet 2, the lower part of each of the columns 6 is fit around each of the projections 7 of the pallet 2 on which the commodity 1 is placed. At this time, it is also possible to construct in such a manner that by fitting each of the projections 7 into the central hole in each of the second joints 9 fixed to the lower parts of the columns 6, the four columns 6 are detachably attached to the four corners of the pallet 2. It is also possible to attach the columns 6 to the pallet 2 by forming attaching holes at the four corners of the pallet and fitting the lower parts of the columns into the attaching holes.

As described above, by preparing a plurality of pallets 2 having different distances D1 and D2 between the projections 7, the columns 6 of which distance is adjusted can be attached to any of the pallets 2.

The first and second coupling members 14 and 15 may not be coupled to each other, that is, be in a free state. In the example shown in the diagram, intermediate portions of the pair of first and second coupling members 14 and 15 are freely turnably coupled by a pivoted pin 21. When the distance between the columns 6 is adjusted, the first and second coupling members 14 and 15 can be smoothly operated and the work of adjusting the distance between neighboring columns can be smoothly performed. Ditto for the embodiment which will be described hereinlater.

Also in the case where the first and second joints 8 and 9 are fit to each of the columns 6 so as to be slidable in the longitudinal direction of the column 6, the work of adjusting the distance of the columns can be performed. When one of the joints, for example, the second joint 9 is fixed to the column 6 as in the example shown in FIG. 1 and the other joint 8 is slidably assembled to the column 6, the first and second coupling members 14 and 15 can be smoothly operated at the time of the work of adjusting the distance between the columns, so that the work can be carried out easily.

On the other hand, as shown in FIGS. 1 to 3, the commodity carrying and storing apparatus of the embodiment has a top plate 33 which can be detachably attached on a plurality of columns, that is, the four columns 6 in the example. The top plate 33 is made of a very rigid material such as a metal plate, a hard resin plate or a wooden plate. In the example, the shape in plan view is a rectangle. At the four corners of the top face of the top plate 33, guide members 34 are fixed, which will be described in detail hereinlater.

In the four corners of the top plate 33 and the guide members 34 fixed to the top face of the top plate 33, holes 35 each penetrating the top plate 33 and the guide member 34 are formed. The upper end 23 of each of the columns 6 is formed so as to be narrowed.

The commodity 1 is placed on the commodity placement face 5 of the pallet 2, the lower part of each of the columns 6 is fit around each of the projections 7 of the pallet 2, and the four columns 6 are attached to the pallet 2. After that, the top plate 33 is lowered from above the four columns 6 as shown by the arrows C in FIG. 1, and the upper end 23 of each of the columns 6 is fit in each of the holes 35 formed in the top plate 33 and the guiding members 34. At this time, each of the holes 35 in the top plate 33 is frictionally fit to each of the upper ends 23, and the top plate 33 is held in this position without moving downward from the position shown in FIG. 2. In such a manner, the top plate 33 is detachably attached onto the plurality of the columns 6.

As described above, the columns 6 are assembled to the pallet 2 and the top plate 33 is attached onto the columns 6, thereby enabling the commodity carrying and storing apparatus 30 assembled as shown in FIG. 2 to be constructed. The commodity 1 (not shown in FIG. 2) placed on the commodity placement face 5 is housed in the housing space surrounded by the four columns 6, the first and second coupling members 14 and 15 and the top plate 33. In such a state, for example, a fork 36 of a fork list truck is inserted under the pallet 2 and is lifted, thereby enabling the commodity carrying and storing apparatus 30 to be lifted and the commodity 1 to be carried. The commodity carrying and storing apparatus 30 on which the commodity 1 is placed can be moved to a track, a ship or a rolling stock and transported. The commodity 1 housed in the commodity carrying and storing apparatus 30 can be stored in a warehouse or the like. As described above, when the commodity 1 is transported or stored, the commodity 1 is surrounded by the first and second coupling members 14 and 15 and the top plate 33. Thus, the commodity 1 can be protected.

When the top plate 33 is lifted so as to be detached from the four columns 6 and the four columns 6 are detached from the pallet 2, the commodity 1 can be easily taken down from the pallet 2. In such a manner, the commodity carrying and storing apparatus can be used many times.

By attaching the top plate 33 onto the four columns 6, the upper ends of the four columns 6 can be coupled to each other via the top plate 33. Consequently, even when an external force is applied laterally to the columns 6 during the commodity 1 is carried or stored, the column 6 can be prevented from being largely fluctuated.

Commodities other than the commodity 1 can be also placed on the top plate 33. In the case of a small commodity 1A as shown by broken lines in FIG. 2, it can be placed in the center area of the top plate 33. In the case of a large commodity 1B as shown by alternate long and short dash lines in FIG. 2, the commodity 1B can be placed on the guide members 34 fixed to the top plate 33. Since each of the guide members 34 is positioned over each of the columns 6 as shown in FIG. 2, when the large commodity 1B is placed on the guide members 34, the load of the commodity 1B can be supported by the four columns 6. Thus, the commodity 1B can be carried or stored in a stable state.

As described above, since various commodities can be placed on the top plate 33, it is possible to place the commodity 1 of a client on the pallet 2, place the commodity of another client on the top plate 33, and transport them by a truck. Such a transporting form of commodities is called a consolidated transportation. By using the top plate 33, the invention can be adapted to the consolidated transportation without a hitch.

In the example shown in FIGS. 1 and 2, the top plate 33 is attached directly onto the plurality of columns 6. It is also possible to fixedly fit a cap (not shown) to the upper end 23 of each of the columns 6 and to attach the top plate 33 to the columns 6 via the caps 23. In such a manner, the top plate 33 can be either directly or via another member detachably attached onto the plurality of columns 6.

On the other hand, on the back face opposite to the commodity placement face 5 of the pallet 2, as shown by partially breaking the leg 4 in FIG. 1, engagement holes 22 are formed in four positions in the bottom part of both of the legs 4 of the pallet 2 (also refer to FIG. 5). The positions of the engagement holes 22 are determined so that the center of each of the engagement holes 22 coincides with the axial line of each of the columns 6 when the columns 6 are attached to the pallet 2 as shown in FIG. 2.

As shown in FIG. 3, a plurality of commodity carrying and storing apparatuses on which the commodities 1 (not shown in FIG. 3) are loaded can be stacked in a stable state. Specifically, the commodity carrying and storing apparatus 30 can be placed in, for example, a warehouse as shown in FIG. 2. On the commodity carrying and storing apparatus 30, as shown in FIG. 3, another commodity carrying and storing apparatus 30A constructed in the same manner as that of the commodity carrying and storing apparatus 30 is lifted by, for example, the fork of a fork lift truck and placed onto the commodity carrying and storing apparatus 30. At this time, as shown in FIG. 2, the upper ends 23 of the four columns 6 of the lower commodity carrying and storing apparatus 30 are projected upward from the holes 35 formed in the top plate 33 and the guiding members 34. The projected upper ends 23 are fit in the engagement holes 22 (FIGS. 1 and 5) formed in the pallet of the upper commodity carrying and storing apparatus 30A. In such a manner, a plurality of commodity carrying and storing apparatuses 30 and 30A can be stacked and the commodities 1 can be stored by effectively utilizing the space in the warehouse. In a state where the plurality of commodity carrying and storing apparatuses are stacked, they can be carried.

As shown in FIG. 3, when the fork 36 of the fork lift truck is inserted under the pallet 2 of the upper commodity carrying and storing apparatus 30A or taken out, since the top plate 33 of the lower commodity carrying and storing apparatus 30 is positioned below the pallet 2, it can be checked that the fork 36 collides against the commodity 1 (FIG. 1) placed on the pallet 2 of the lower commodity carrying and storing apparatus 30. As described above, the top plate 33 also has the function of protecting the commodity 1 placed on the commodity carrying and storing apparatus from a cargo gear such as the fork 36.

Figure 6:
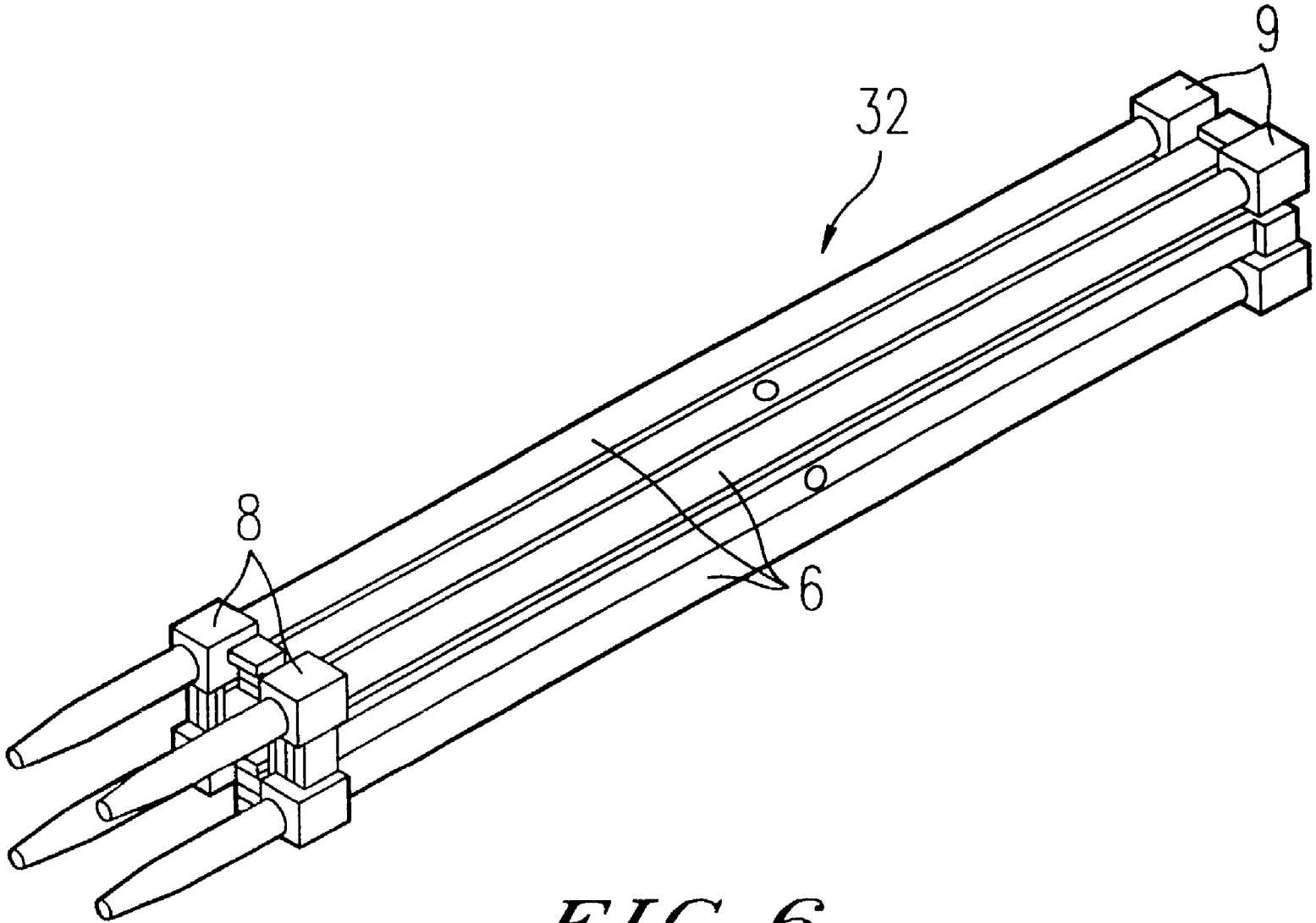
FIG. 6 is a perspective view showing a state where a column unit illustrated in FIG. 1 is folded.

When the commodity carrying and storing apparatus is not used, the top plate 33 is detached from the four columns 6 and the four columns 6 are pulled out from the pallet 2. When the columns 6 are moved so as to come close to each other, the first and second coupling members 14 and 15 are folded and the components can be compactly folded as shown in FIG. 6 and stored in an extremely small space. As described above, the plurality of columns 6 and the coupling members 14 and 15 serving as the coupling means construct a column unit 32 which can be folded in a state where the plurality of columns 6 are detached from the pallet 2.

As described above, according to the commodity carrying and storing apparatus shown in FIGS. 1 to 6, whatever the substantial size of the commodity 1 to be carried or stored is, by selecting the pallet 2 corresponding to the size and adjusting the distance between the columns 6 in accordance with each of the distances D1 and D2 of the projections 7, the commodity can be easily carried or stored.

Figure 7:
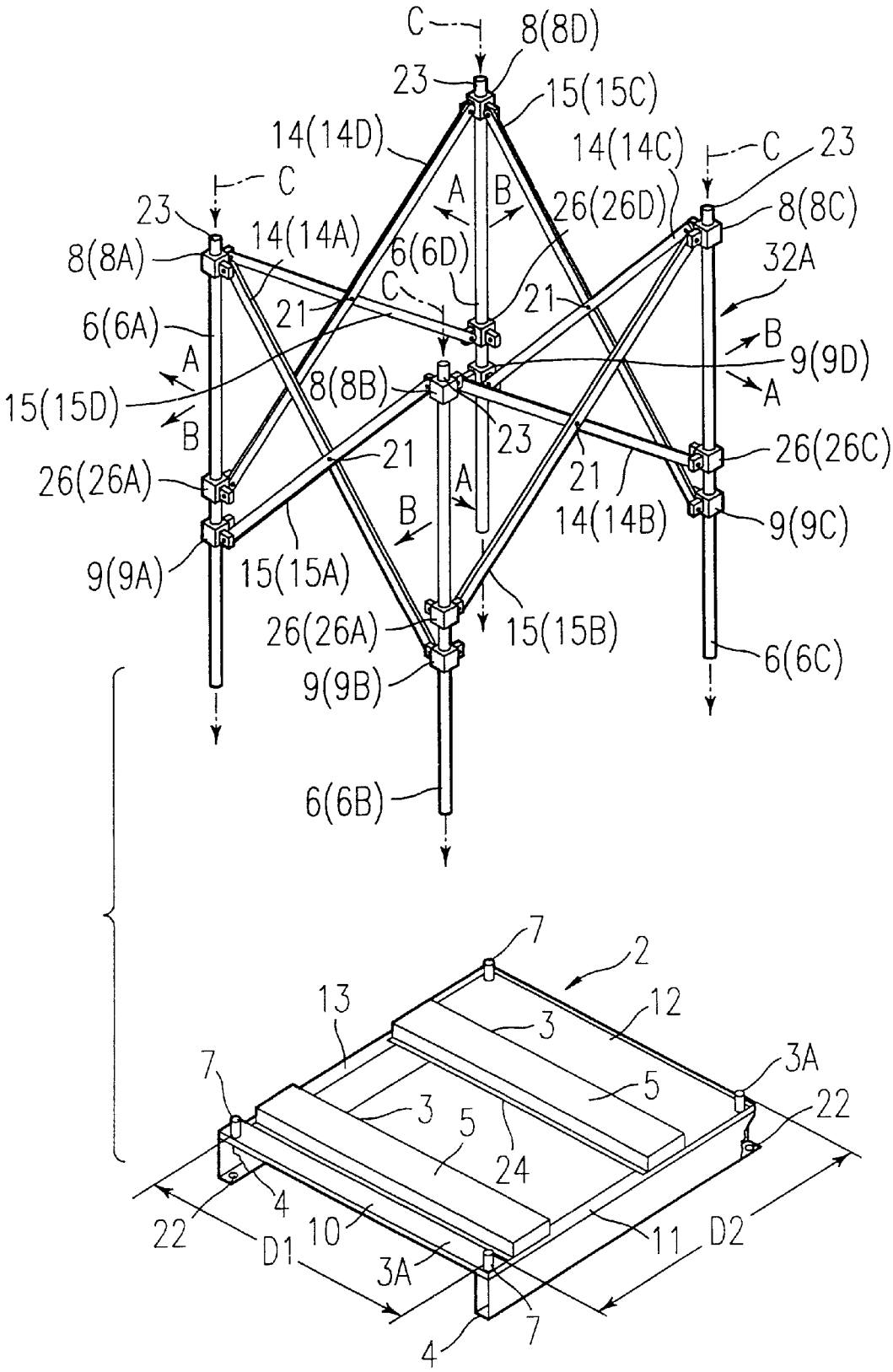
FIG. 7 is a perspective view showing an embodiment of a commodity carrying and storing apparatus different from that in FIG. 1.
Figure 8:
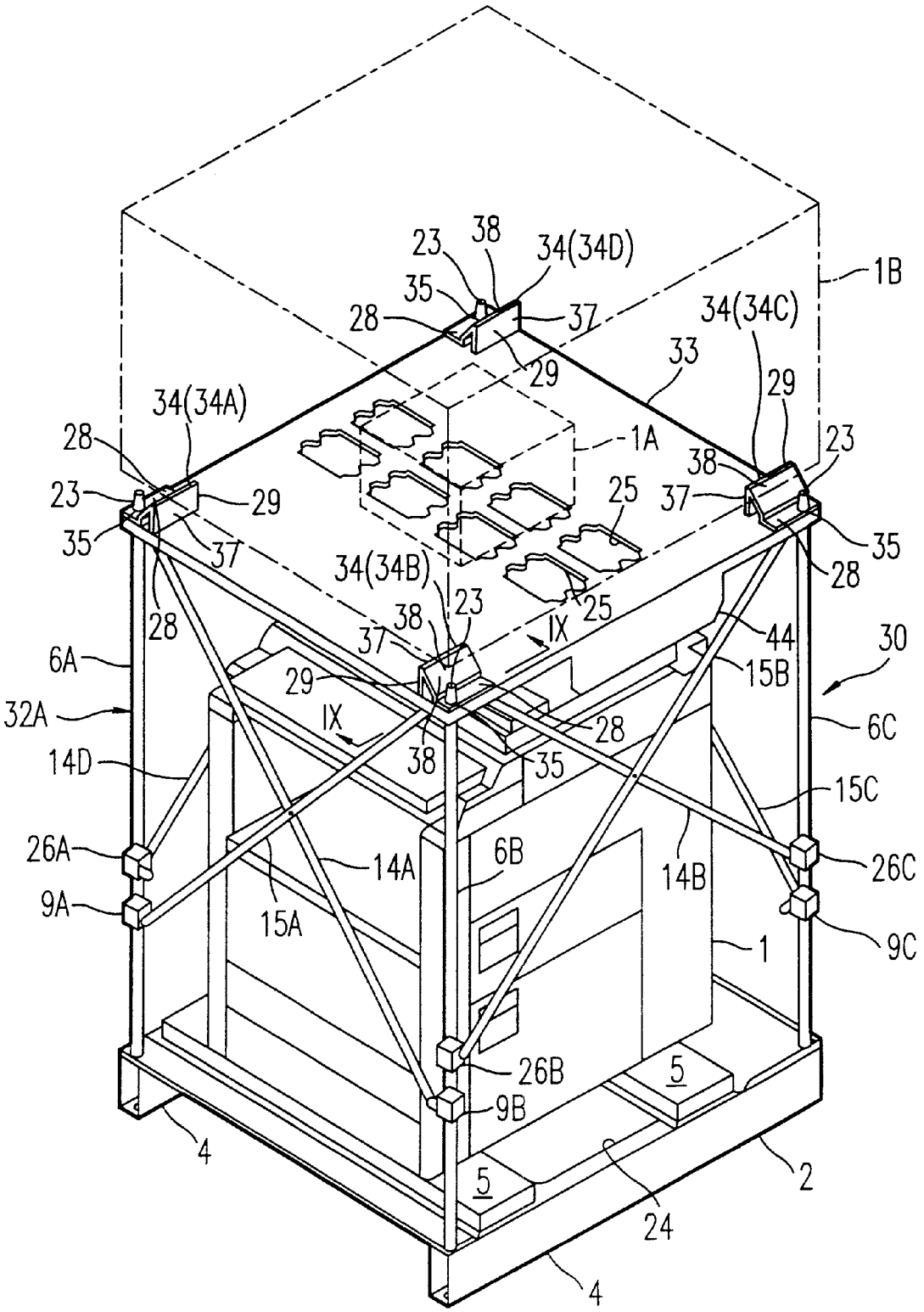
FIG. 8 is a perspective view showing a state where the commodity carrying and storing apparatus illustrated in FIG. 7 is assembled.
Figure 9:
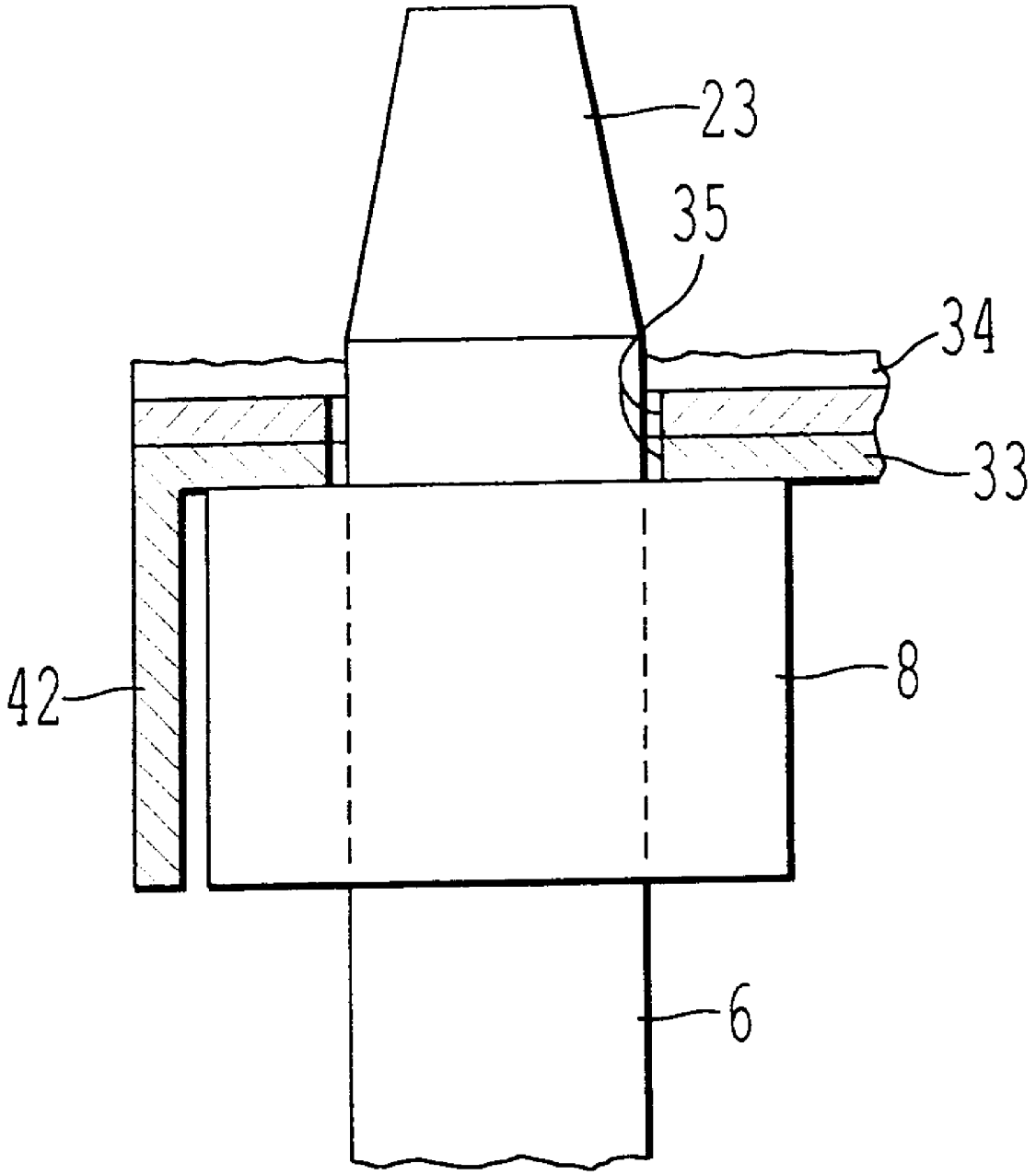
FIG. 9 is an enlarged cross section taken along line IX—IX of FIG. 8.

The commodity carrying and storing apparatus of the embodiment described above will be called a commodity carrying and storing apparatus of the first form. A commodity carrying and storing apparatus which will now be described by referring to FIGS. 7 to 14 will be called a commodity carrying and storing apparatus of the second form. As shown in FIG. 7 to 9, the commodity carrying and storing apparatus of the second form also comprises: the pallet 2 on which the commodity 1 such as a copying machine is placed; the plurality of columns 6 detachably attached to the pallet 2 in positions so as to surround the commodity 1 placed on the commodity placement face 5 of the pallet 2; coupling means for coupling neighboring two columns while adjusting the distance between the two columns; and the top plate 33 (not shown in FIG. 7) which can be detachably attached onto the plurality of the columns 6 directly or via another member.

In the embodiment as well, the apparatus has the first to fourth columns 6A, 6B, 6C and 6D detachably attached to the pallet 2 almost perpendicularly to the commodity placement face 5 of the pallet 2. When a rectangle is imagined on the pallet 2, the columns 6 can be detachably vertically formed at the corners of the rectangle. In the example of FIG. 7 as well, by fitting the lower part of each of the columns 6 which are constructed by hollow pipes around each of the projections 7 provided at the four corners of the pallet 2, the columns 6 are easily attached or detached to/from the pallet 2 by a manual operation. The construction of the pallet 2 shown in FIGS. 7 and 8 is the same as that of the pallet 2 shown in FIG. 1.

The top plate 33 is substantially the same as that in the commodity carrying and storing apparatus of the first form shown in FIGS. 1 to 6. The guide members 34 are fixed to the four corners of the top face and the holes 35 are formed so as to penetrate the top plate 33 and the guiding members 34 fixed to the four corners.

In the example shown in FIG. 7, the coupling means for coupling the two columns 6 has not only the first and second coupling members 14 and 15 and the first and second joints 8 and 9 but also third joints 26. The third joints 26 are designated by reference numerals 26A, 26B, 26C and 26D so as to discriminate from each other. In the following, the details of the coupling means will be clarified.

The coupling means of the commodity carrying and storing apparatus of the second form shown in FIG. 7 has the first to third joints 8, 9 and 26 attached to each of the first to fourth columns 6A to 6D along the longitudinal direction of the column. Moreover, in a manner similar to the coupling means of the commodity carrying and storing apparatus of the first form shown in FIG. 1, the apparatus has the pair of coupling members, that is, the first and second coupling members 14 and 15 for coupling the first and second columns 6A and 6B, second and third columns 6B and 6C, third and fourth columns 6C and 6D, and fourth and first columns 6D and 6A. Each pair of the columns are positioned adjacent to each other in each of the sides 10 to 13 of the pallet 2.

In the state where the four columns 6 are attached to the pallet 2, the second and third joints 9 and 26 are positioned lower than the first joint 8 and the second joint 9 is positioned lower than the third joint 26. In the state where the first to fourth columns 6A to 6D are attached to the pallet 2, the pair of coupling members, that is, the first and second coupling members 14 and 15 are positioned in a state where they cross each other.

Further, each of the ends in the longitudinal direction of each of the first and second coupling members 14 and 15 is swingably coupled to each of the joints via a pin in a manner similar to the case shown in FIGS. 3 and 4.

In the state where the first to fourth columns 6A to 6D are attached to the pallet 2, one ends in the longitudinal direction of the first and second coupling members 14A and 15A provided between the first and second columns 6A and 6B which are adjacent to each other in the first side 10 in the pallet 2 are turnably coupled to the first joints 8A and 8B attached to the first and second columns 6A and 6B. The other ends in the longitudinal direction are turnably coupled to the second joints 9B and 9A attached to the second and first columns 6B and 6A, respectively.

Similarly, one ends in the longitudinal direction of the first and second coupling members 14B and 15B provided between the second and third columns 6B and 6C which are adjacent to each other in the second side 11 next to the first side 10 of the pallet 2 are turnably coupled to the first joints 8B and 8C attached to the second and third columns 6B and 6C, respectively. The other ends in the longitudinal direction are turnably coupled to the third joints 26C and 26B attached to the third and second columns 6C and 6B, respectively.

Further, one ends in the longitudinal direction of the first and second coupling members 14C and 15C provided between the third and fourth columns 6C and 6D which are adjacent to each other in the third side 12 next to the second side 11 in the pallet 2 are turnably coupled to the first joints 8C and 8D attached to the third and fourth columns 6C and 6D, respectively. The other ends in the longitudinal direction are turnably coupled to the second joints 9D and 9C attached to the fourth and third columns 6D and 6C, respectively.

One ends in the longitudinal direction of the first and second coupling members 14D and 15D provided between the fourth and first columns 6D and 6A which are positioned adjacent to each other in the fourth side 13 next to the third side 12 in the pallet 2 are turnably coupled to the first joints 8D and 8A attached to the fourth and first columns 6D and 6A, respectively. The other ends in the longitudinal direction are turnably coupled to the third joints 26A and 26D attached to the first and fourth columns 6A and 6D, respectively.

As described above, one ends in the longitudinal direction of the first and second coupling members provided between the first and second columns which are positioned adjacent to each other and the first and second coupling members provided between the third and fourth columns which are positioned so as to face the first and second columns are turnably coupled to the first joints attached to the first, second, third and fourth columns. The other ends in the longitudinal direction are turnably coupled to the second joints attached to the first, second, third and fourth columns. One ends in the longitudinal direction of the first and second coupling members provided between the second and third columns which are positioned adjacent to each other and the first and second coupling members provided between the fourth and first columns which are positioned so as to face the second and third columns are turnably coupled to the first joints attached to the second and third columns, and the fourth and first columns. The other ends in the longitudinal direction are turnably coupled to the third joints attached to the second and third columns, and the fourth and first columns.

Among the first to third joints 8, 9 and 26 coupled to the first and second coupling members 14 and 15, at least second and third joints 9 and 26 are movably assembled to each of the columns 6 to which the second and third joints 9 and 26 are attached so as to be freely movable in the longitudinal direction of the column 6. In the example of the diagram, the first joint 8 at the top of each of the columns 6 is fixed to the column 6 by press-fitting, screwing, welding or the like. The second and third joints 9 and 26 are fit to the column 6 so as to be slidable in the longitudinal direction of the column 6. The first joint 8 may be attached to each column 6 slidably in the longitudinal direction.

Figure 14:
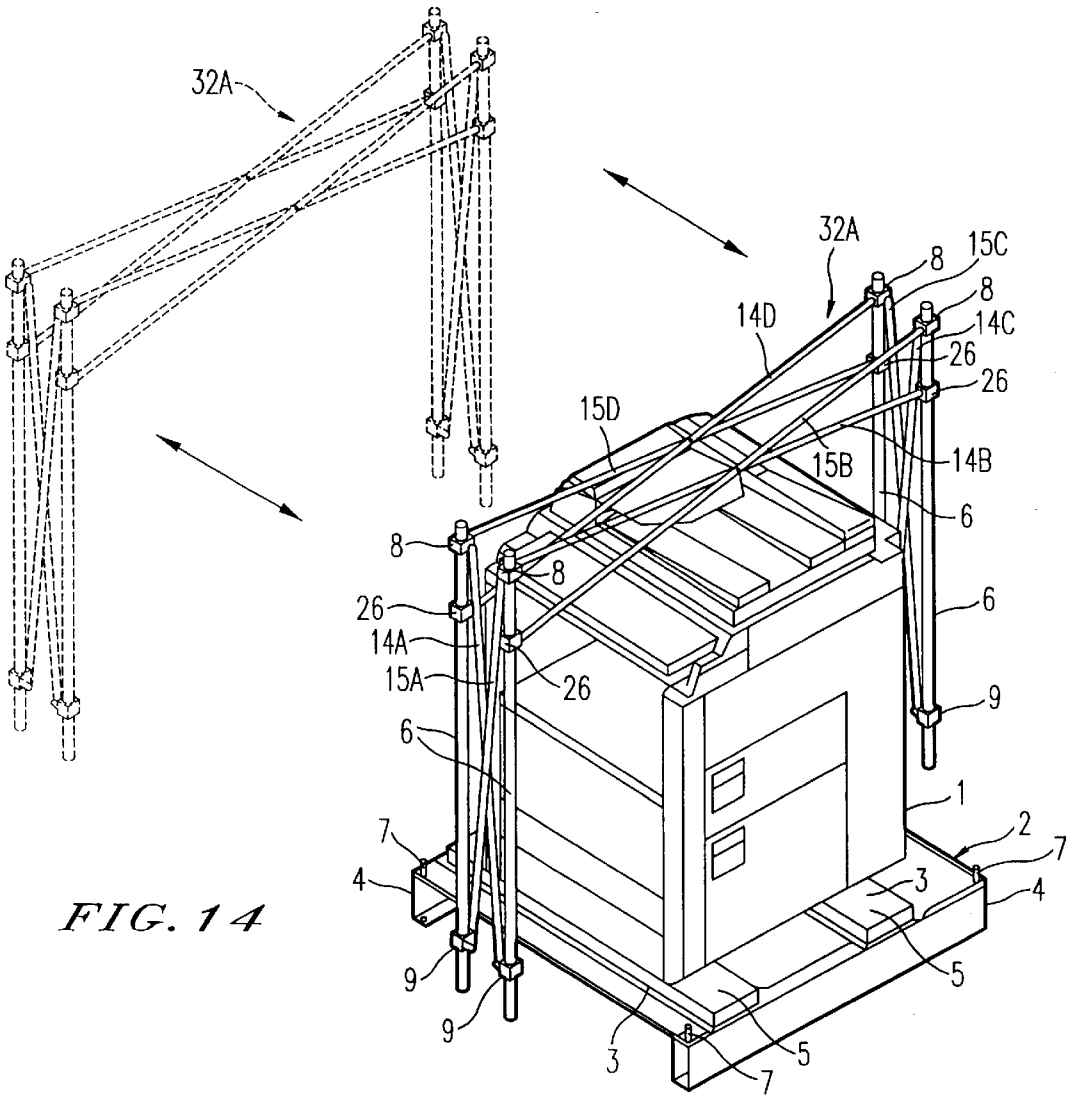
FIG. 14 is a perspective view showing a state where the column unit is attached/detached to/from the pallet.

When a commodity is carried or stored by the commodity carrying and storing apparatus of the second form shown in FIG. 7, the pallet 2 adapted to the size of the commodity is selected. As shown in FIG. 14, the commodity 1 is placed on the pallet 2 and is positioned to the pallet 2 or detachably fixed. On the other hand, the distance between the columns 6 before being attached to the pallet 2 is adjusted as follows so as to be adapted to the distances D1 and D2 (FIG. 7) between the projections 7 of the selected pallet 2.

Specifically, the neighboring first and second columns 6A and 6B and the neighboring third and fourth columns 6C and 6D which are attached adjacent each other in the first side 10 in the pallet 2 and the third side 12 facing the first side 10, respectively, are pressed in the directions shown by the arrow A in FIG. 7 or in the opposite directions. Then the second joints 9 attached to the columns slide upward or downward along the columns 6, so that the distance between the first and second columns 6A and 6B and the distance between the third and fourth columns 6C and 6D change at the same ratio. At that time, in the example, only by adjusting the distance between the columns 6A and 6B and the distance between the columns 6C and 6D, the distance between the second column 6B and the third column 6C and the distance between the fourth column 6D and the first column 6A are not changed.

In the case of adjusting the distances, a force is applied to the second and third columns 6B and 6C and the fourth and first columns 6D and 6A in the direction shown by the arrows B in FIG. 7 or in the opposite direction. By the operation, the third joints 26 fit in the columns 6 are moved upward or downward along the columns 6, so that the distance between the second and third columns 6B and 6C and the distance between the fourth and first columns 6D and 6A change at the same ratio.

As described above, in the commodity carrying and storing apparatus of the second form, the distance between the two neighboring columns attached to one side in the pallet 2 and the distance between the two neighboring columns attached to the opposite side are adjusted interlockingly so as to change at the same ratio. Moreover, the distances are interlockingly adjusted so that the distances each between two neighboring columns in the other opposite sides of the pallet 2 change at the same ratio. That is, the coupling means for coupling two columns is constructed to interlockingly adjust the distance between neighboring two neighboring columns 6 and the distance between other two columns 6 which face the above two columns 6 so that the distances change at the same ratio. Consequently, the distance between columns can be more freely adjusted than the case of the commodity carrying and storing apparatus of the first form shown in FIG. 1. The columns 6 of which distance has been adjusted are attached to the pallet 2 on which the commodity 1 is placed as described above.

By preparing the pallet 2 having the distances D1 and D2 between the projections 7 to which the columns 6 can be attached, the columns 6 subjected to distance adjustment can be attached to any of the pallets 2.

After attaching the four columns to the pallet 2, the top plate 33 is lowered as shown by the arrows C in FIG. 3 from above. As shown in FIGS. 8 and 9, the upper ends 23 of the columns 6 are fit in the holes 35 of the top plate 33, thereby detachably attaching the top plate 33 onto the plurality of columns 6. In the example, the upper ends 23 of the columns 6 projected upper than the second joints 8 are directly fit into the holes 35 formed in the top plate 33 and the guiding members 34, and the top plate 33 is placed on the top faces of the four first joints 8 so as to be supported. As described above in association with the first commodity carrying and storing apparatus, it is also possible to frictionally fit the upper ends 23 of the columns 6 into the holes 35, attach caps (not shown) to the upper ends 23, and fit the caps into the holes 35 formed in the top plate 33 and the guiding members 34. Alternately, pins in forms similar to the upper ends 23 of the columns 6 shown in FIG. 7 may be fixed to the upper ends of the first joints 8 and fit into the holes 35. In such a manner, the top plate 33 is detachably attached onto the plurality of columns 6 directly or via another member.

As described above, as shown in FIG. 8, a commodity carrying and storing apparatus 30 having the function similar to that of the commodity carrying and storing apparatus of the first form can be constructed. The commodity 1A or 1B shown by broken lines or alternate long and short dash lines in FIG. 8 can be placed on the top plate 33 in a manner similar to the foregoing example.

Figure 10:
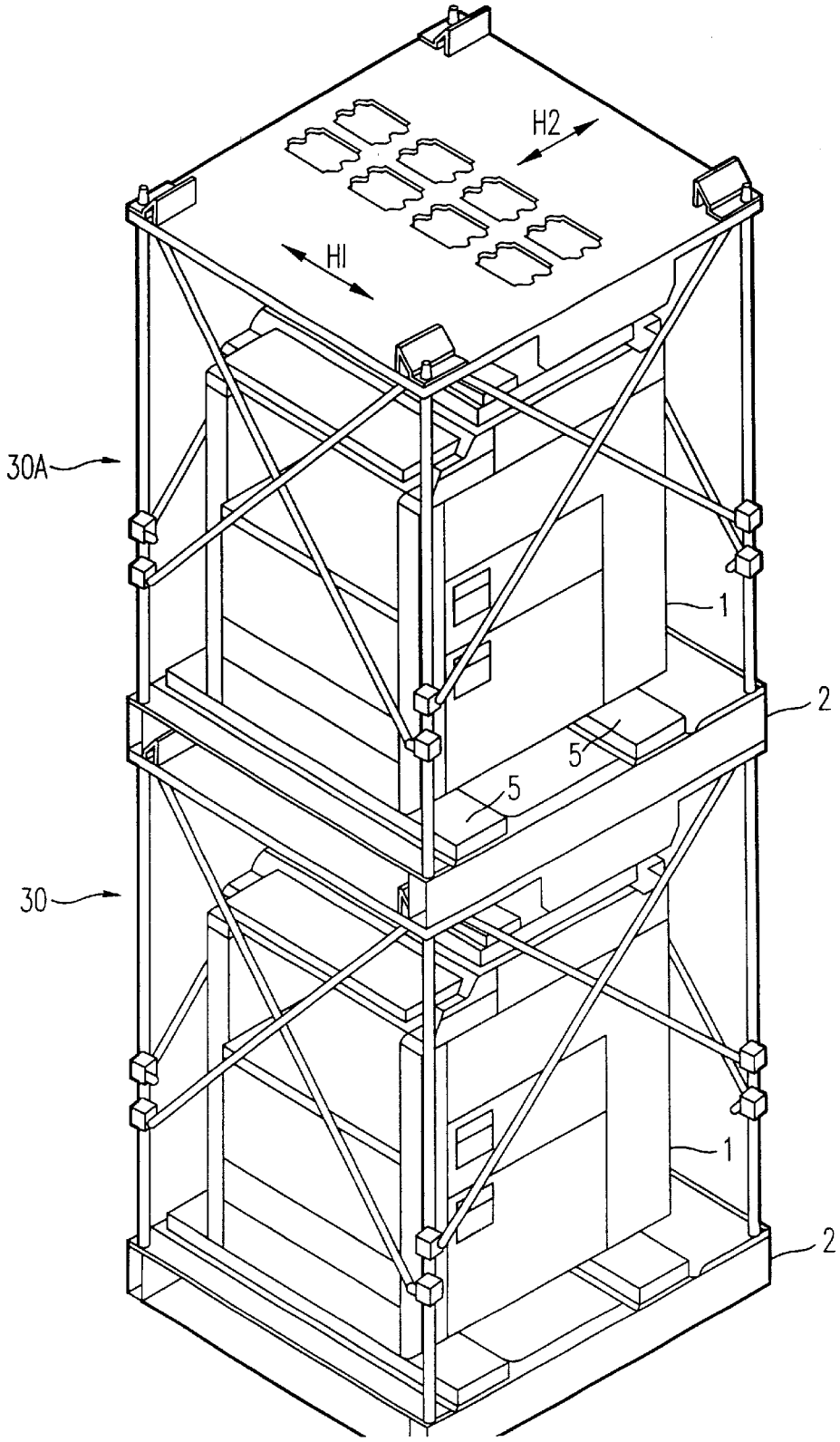
FIG. 10 is a perspective view showing a state where the commodity carrying and storing apparatus illustrated in FIG. 7 is assembled and a plurality of commodity carrying and storing apparatuses are stacked.

Consequently, in a manner quite similar to the case of the commodity carrying and storing apparatus of the first form described above, the commodity 1 placed on the commodity placement face 5 of the pallet 2 can be carried or stored. The commodity carrying and storing apparatuses of the second form can be also stacked as shown in FIG. 10. In this case as well, the upper ends 23 of the columns 6 projected from the holes 35 of the top plate 33 and the guiding members 34 of the lower commodity carrying and storing apparatus 30 are fit in the four engagement holes 22 (FIG. 7) formed on the back face opposite to the commodity placement face 5 of the pallet 2 of the upper commodity carrying and storing apparatus 30A. In such a manner, the commodity carrying and storing apparatuses 30 and 30A are stacked and the commodity 1 can be stored in a small space or carried. By detaching the top plate 33 from the columns 6 and detaching the four columns 6 from the pallet 2, the commodity on the pallet 2 can be easily unloaded to the floor face or the like.

Figure 11:
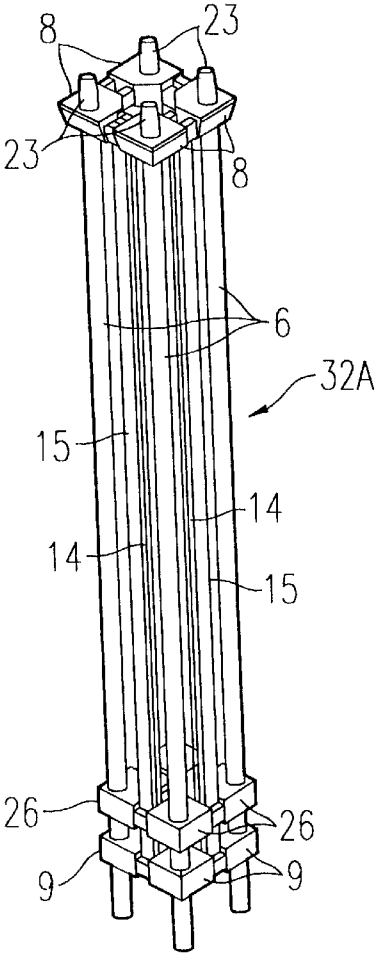
FIG. 11 is a perspective view showing a state where the column unit illustrated in FIG. 7 is folded.

Also in the case of the commodity carrying and storing apparatus of the second form shown in FIG. 7, when the top plate 33 is detached from the columns 6 and the columns 6 are pulled out from the pallet 2, the columns 6 and the first and second coupling members 14 and 15 can be compactly folded as shown in FIG. 11. That is, also in the commodity carrying and storing apparatus of the second form shown in FIG. 7, the plurality of columns 6 and the coupling members 14 and 15 as the coupling members construct a column unit 32A which can be folded in a state where the columns 6 are detached from the pallet 2.

Figure 12:
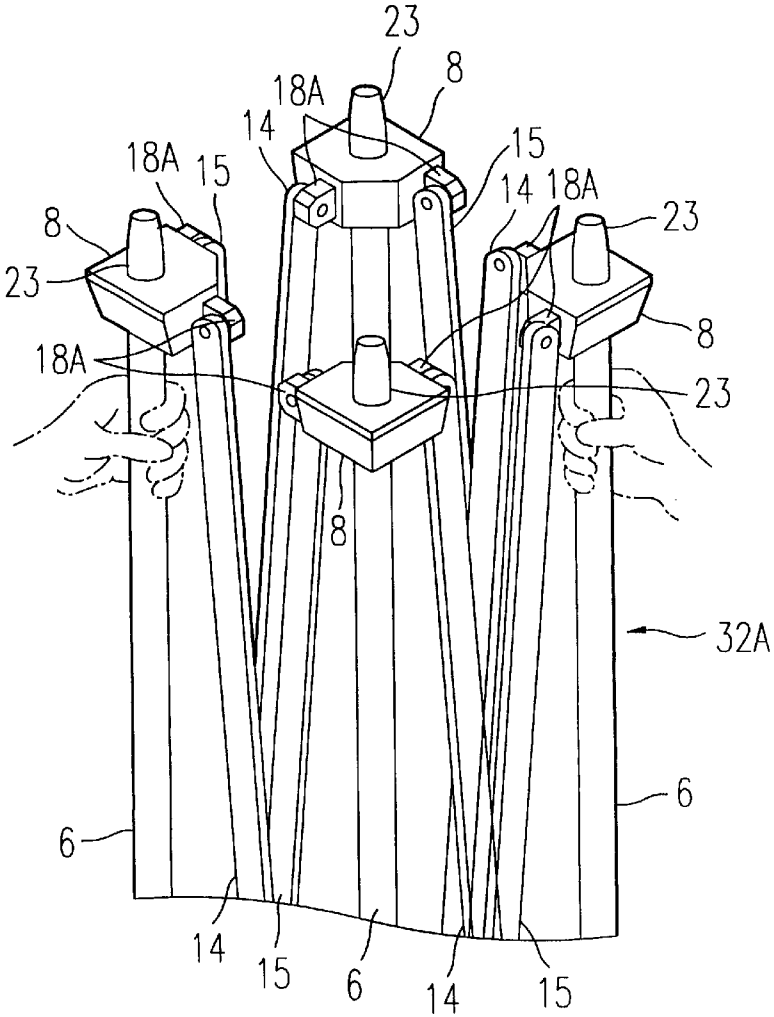
FIG. 12 is a perspective view showing a state of folding the column unit.
Figure 13:
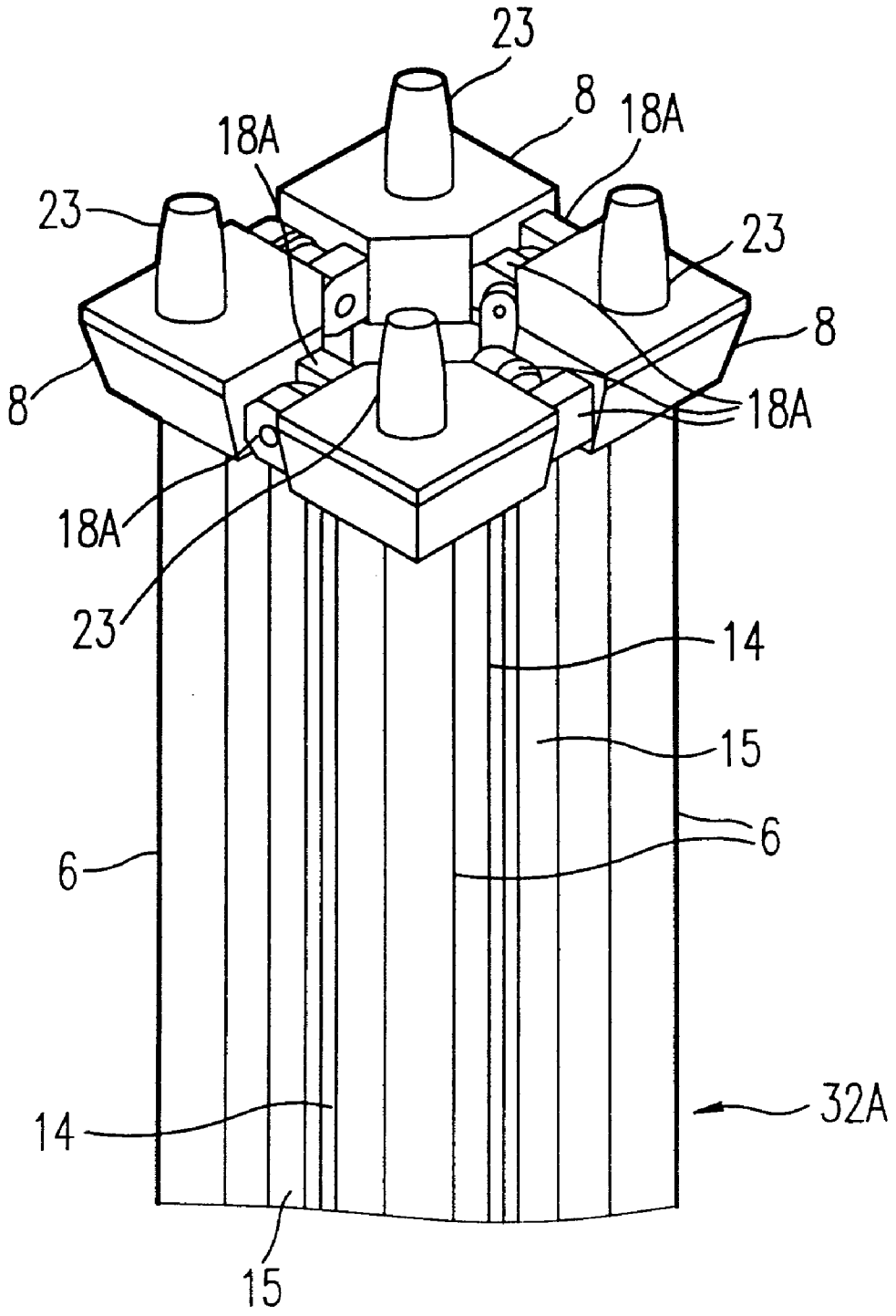
FIG. 13 is a perspective view showing the folded column unit.

In the case of folding the column unit 32A, as shown by alternate long and short dash lines in FIG. 12, the user grips the columns 6 and draws them close to each other, thereby enabling the column unit 32A to be folded as shown in FIG. 13. The column unit 32 shown in FIG. 1 can be also similarly folded. Reference numeral 18A in FIGS. 12 and 13 denotes tongue pieces for coupling the coupling members 14 and 15 to the joints 8 and corresponds to the tongue pieces 16 illustrated in FIG. 4.

FIG. 7 shows a state that the commodity 1 is placed and positioned or detachably fixed on the pallet 2, the column unit 32A is lowered from above the pallet 2, and the lower parts of the columns 6 are fit around the projections 7 of the pallet 2 to thereby attach the column unit 32A to the pallet 2 or a state where the column unit 32A is lifted and detached from the pallet 2. Also in the commodity carrying and storing apparatus of the first form shown in FIGS. 1 to 6, the column unit 32 can be attached/detached to/from the pallet 2 in the above manner.

On the other hand, FIG. 14 shows the method of attaching or detaching the column unit 32A to/from the pallet 2 by sliding the third joints 26 of the column unit 32A shown in FIG. 7 upward, lifting the first and second coupling members 14B and 15B and the first and second coupling members 14D and 15D which face the members 14B and 15B, sliding the second joints 9 downward, folding the first and second coupling members 14A, 15A, and 14C, 15C and moving the column unit 32A in the horizontal direction. According to the method, it is unnecessary to vertically move the column unit 32A, so that the work can be very easily performed. Moreover, in a state where the columns 6 are set largely apart from the commodity 1, the column unit 32A is moved in the horizontal direction. Consequently, the column unit 32A can be attached/detached to/from the pallet 2 without making the columns 6 and the first and second coupling members 14 and 15 come into contact with the commodity. Thus, the work can be carried out without damaging the commodity 1.

Although the basic construction of the commodity carrying and storing apparatus has been described above, in the commodity carrying and storing apparatus of any of the forms, when a plurality of commodity carrying and storing apparatuses are stacked by placing the upper commodity carrying and storing apparatus on the lower commodity carrying and storing apparatus, the upper commodity carrying and storing apparatus has to be easily and accurately positioned and placed on the lower commodity carrying and storing apparatus.

In order to achieve the object, in the commodity carrying and storing apparatus shown in the diagram, the guiding members 34 are fixed to the top face of the top plate 33. Since the construction and action of the guiding member 34 provided for the commodity carrying and storing apparatus of the first form shown in FIGS. 1 to 6 are substantially the same as those of the guiding member 34 in the commodity carrying and storing apparatus of the second form shown in FIGS. 7 to 14, they will be described in a lump hereinbelow.

When it is necessary to identify each of the four guiding members 34 fixed at the four corners of the top face of the top plate 33 of the commodity carrying and storing apparatus 30 shown in FIGS. 2 and 8, they will be called a first guiding member 34A, a second guiding member 34B, a third guiding member 34C and a fourth guiding member 34D. As shown in the diagrams, each of the first and second guiding members 34A and 34B is constructed by a high rigid plate member such as a metal plate or a hard resin plate and has a base part 28 which is flatly formed and a projected part 29 which is formed integrally with the base part 28 and is projected upward. The base part 28 of each of the guiding members 34A and 34B is fixed to each of the corners of the top face of the top plate 33 by fixing means such as welding or screwing. The hole 35 is formed in each of the base parts 28. Each of the projected parts 29 has: a perpendicular part 37 which is upright almost perpendicular to the top face of the top plate 33; and an inclined part which extends and is inclined from the apex of the perpendicular part 37 to the base part 28. An inclined face 38 is formed as the outer face of the inclined part.

The first and second guiding members 34A and 34B positioned apart from each other are disposed symmetrically. The perpendicular parts 37 and 37 face each other and the inclined faces 38 and 38 are inclined so that the distance between the inclined faces 38 and 38 is gradually increased from the apex parts of the perpendicular parts 37 and 37 toward the bottom.

As obviously understood from FIGS. 2 and 8, the third and fourth guiding members 34C and 34D are constructed in a manner similar to the first and second guiding members 34A and 34B and are fixed to the corners of the top face of the top plate 33 with the same positional relation. The inclined faces 38 and 38 of the first and fourth guiding members 34A and 34D are positioned almost on the same plane. Similarly, the guide faces 38 and 38 of the second and third guiding members 34B and 34C are positioned on almost the same plane.

Figure 15:
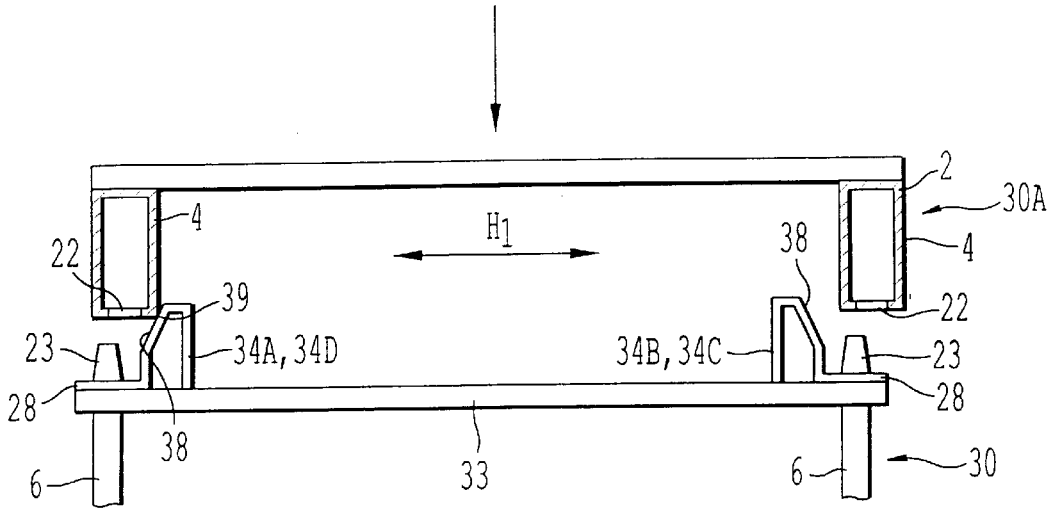
FIG. 15 is a partial cross section showing a state where an upper commodity carrying and storing apparatus is stacked on the lower commodity carrying and storing apparatus.
Figure 16:
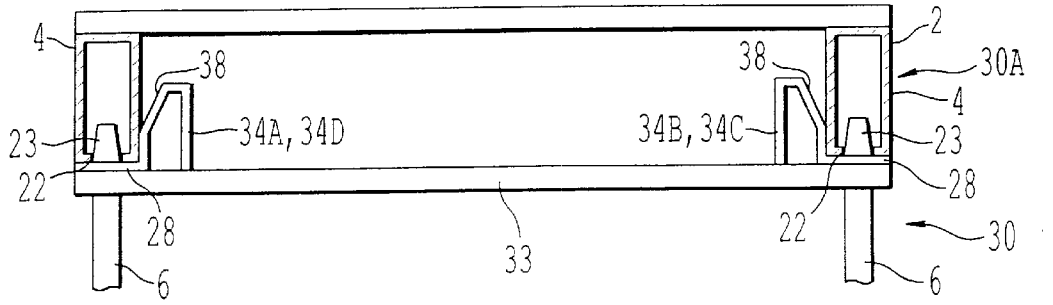
FIG. 16 is a partial cross section showing a state where the upper commodity carrying and storing apparatus is stacked on the lower commodity carrying and storing apparatus.

FIGS. 15 and 16 are diagrams showing a state where the upper commodity carrying and storing apparatus 30A is lowered from above the lower commodity carrying and storing apparatus 30 and is placed on the lower commodity carrying and storing apparatus 30. As shown in FIG. 15, when the upper commodity carrying and storing apparatus 30A is lowered, even if the position of the commodity carrying and storing apparatus 30A and that of the lower commodity carrying and storing apparatus 30 are not aligned and the upper commodity carrying and storing apparatus 30A is slightly deviated in the horizontal direction H1 from the lower commodity carrying and storing apparatus 30, the inner corners 39 of one of the legs 34 of the pallet 2 of the upper commodity carrying and storing apparatus 30A come into contact with the inclined faces 38 of the guiding members 34A and 34B (or 34D and 34C) which face each other and are guided along the inclined faces 38.

Consequently, the upper commodity carrying and storing apparatus 30A is lowered while its position in the horizontal direction H1 is corrected. Finally, the legs 4 of the upper commodity carrying and storing apparatus 30A are placed and positioned on the top face of the base parts 28 of the guiding members 34 as shown in FIG. 16 (also refer to FIG. 10). At this time, the upper ends 23 of the columns 6 projected upward from the base parts 28 of the guiding members 34 are fit in the engagement holes 22 formed in the legs 4 of the upper commodity carrying and storing apparatus 30A.

As described above, the inclined face 38 of the guiding member 34 functions as a guide face for guiding the upper commodity carrying and storing apparatus 30 in one of the horizontal directions H1, that is, in the lateral direction of the upper commodity carrying and storing apparatus 30A in FIG. 8.

Each of the engagement holes 22 formed in the legs 4 of the commodity carrying and storing apparatus is a long hole that is elongated in the horizontal direction H1 as shown in FIGS. 2, 5 and 7. When the engagement hole 22 has the circular shape having the diameter almost the same as that of the upper end 23 of the column 6, it is sometimes difficult to lower the upper commodity carrying and storing apparatus 30A and accurately fit the upper end 23 of the column 6 to the circular engagement hole 22. When the engagement hole 22 is formed in a long hole, the upper commodity carrying and storing apparatus 30A is automatically positioned to the lower commodity carrying and storing apparatus 30 while being guided by the guiding member 34 in one of the horizontal directions H1. Consequently, the upper end 23 of each of the columns 6 can be easily fit in each of the engagement holes 22. By fitting the upper end 23 of the column 6 in the long engagement hole 22, the upper commodity carrying and storing apparatus 30A can be positioned to the lower commodity carrying and storing apparatus 30 in the other horizontal direction H2 (FIGS. 5 and 10) which is orthogonal to the one of the horizontal directions H1.

Figure 19:
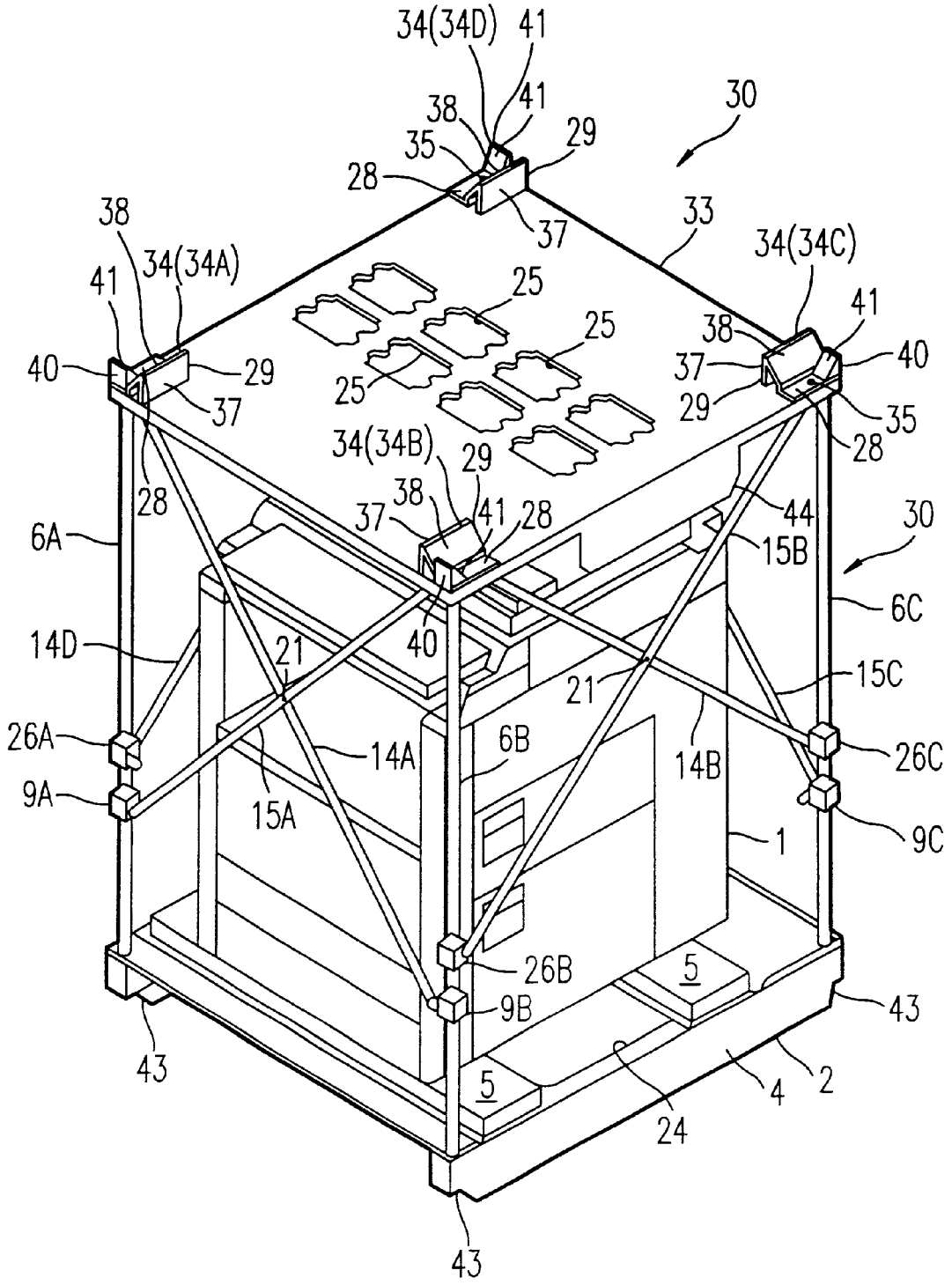
FIG. 19 is a perspective view showing further another example of a commodity carrying and storing apparatus.
Figure 20:
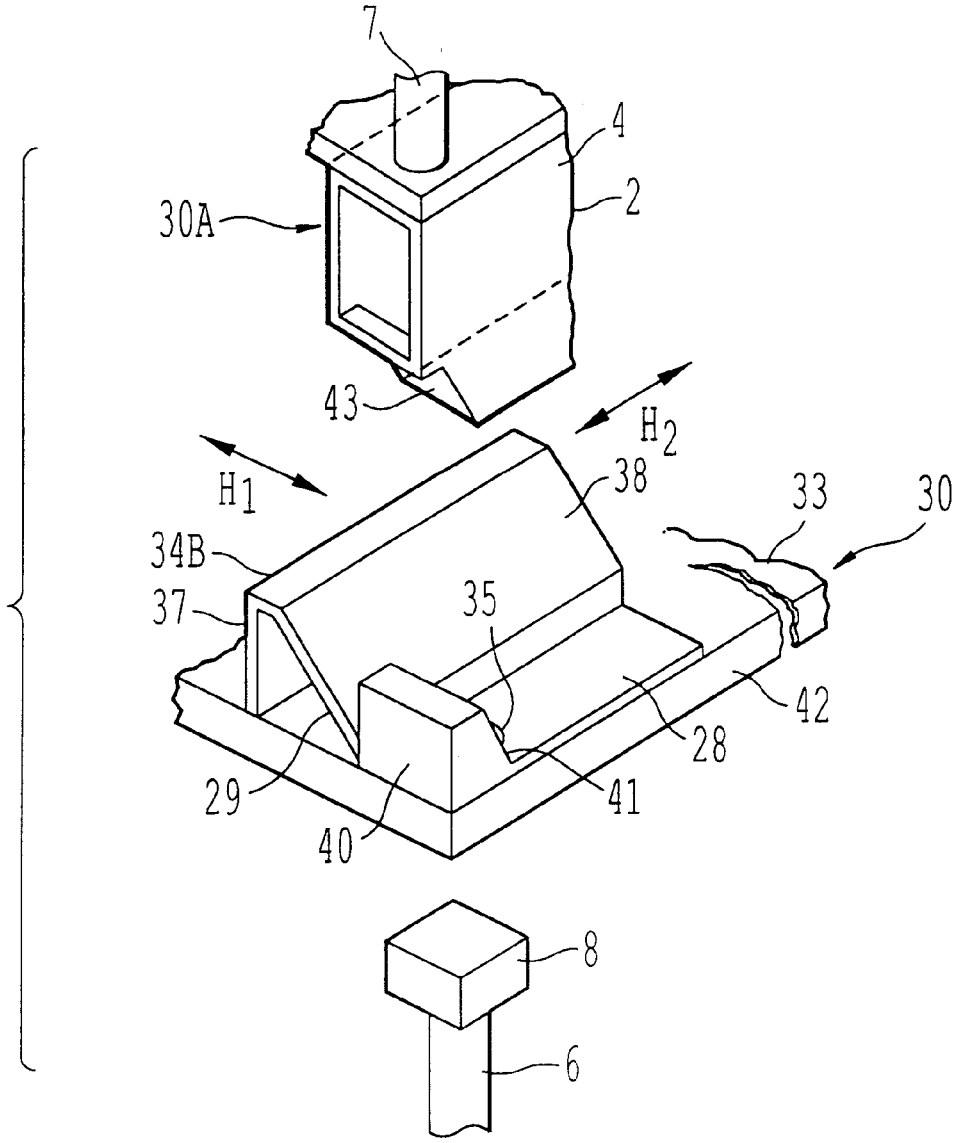
FIG. 20 is a perspective view showing a state of stacking the commodity carrying and storing apparatuses illustrated in FIG. 19.

FIG. 19 is a perspective view showing another example of the first to fourth guiding members 34A, 34B, 34C and 34D of the commodity carrying and storing apparatus 30 of the second form. FIG. 20 is an enlarged perspective view of the second guiding member 34B. Each of the guiding members 34 is different from each of the guiding members shown in FIGS. 2 and 8 with respect to the point that a guide piece 40 fixed to the base part 28 is added to each of the guiding members 34 shown in FIGS. 2 and 8. As shown in FIG. 19, the guide pieces 40 and 40 of the second and third guiding members 34B and 34C face each other and the opposite faces are formed as inclined faces 41. The inclined faces 41 and 41 are inclined so that the distance between the opposite inclined faces 41 and 41 of the guiding members 34B and 34C gradually increases from the apex of each of the guide pieces 40 toward the base part 28 at the lower end.

The first and fourth guiding members 34A and 34D shown in FIG. 19 are constructed in a manner similar to the second and third guiding members 34B and 34C and disposed with the same positional relation. The inclined faces 41 and 41 of the first and second guiding members 34A and 34B are positioned in almost the same plane. The guide faces 41 and 41 of the third and fourth guiding members 34C and 34D are positioned in almost the same plane.

In the example, as shown in FIG. 20, the upper end of each of the columns 6 to which the first joints 8 are fixed is not projected from the first joint 8. The corners of the top plate 33 are placed on the first joints 8. Moreover, in a state where a flange 42 which extends downward from the top plate 33 is in contact with a side face of each of the joints 8, the top plate 33 is attached on the columns 6 (also refer to FIG. 9). As shown in FIGS. 19 and 20, a notch 43 which can be engaged with the guide piece 40 is formed in each of the ends in the longitudinal direction of each of the legs 4 of the pallet 2. An engagement hole (not shown in FIGS. 19 and 20) is formed in each of the legs 4 of the pallet 2 in a manner similar to the above example. The engagement hole is formed larger than that in the above example. The other construction is the same as that of the commodity carrying and storing apparatus of the second form shown in FIGS. 7 to 16.

Figure 21:
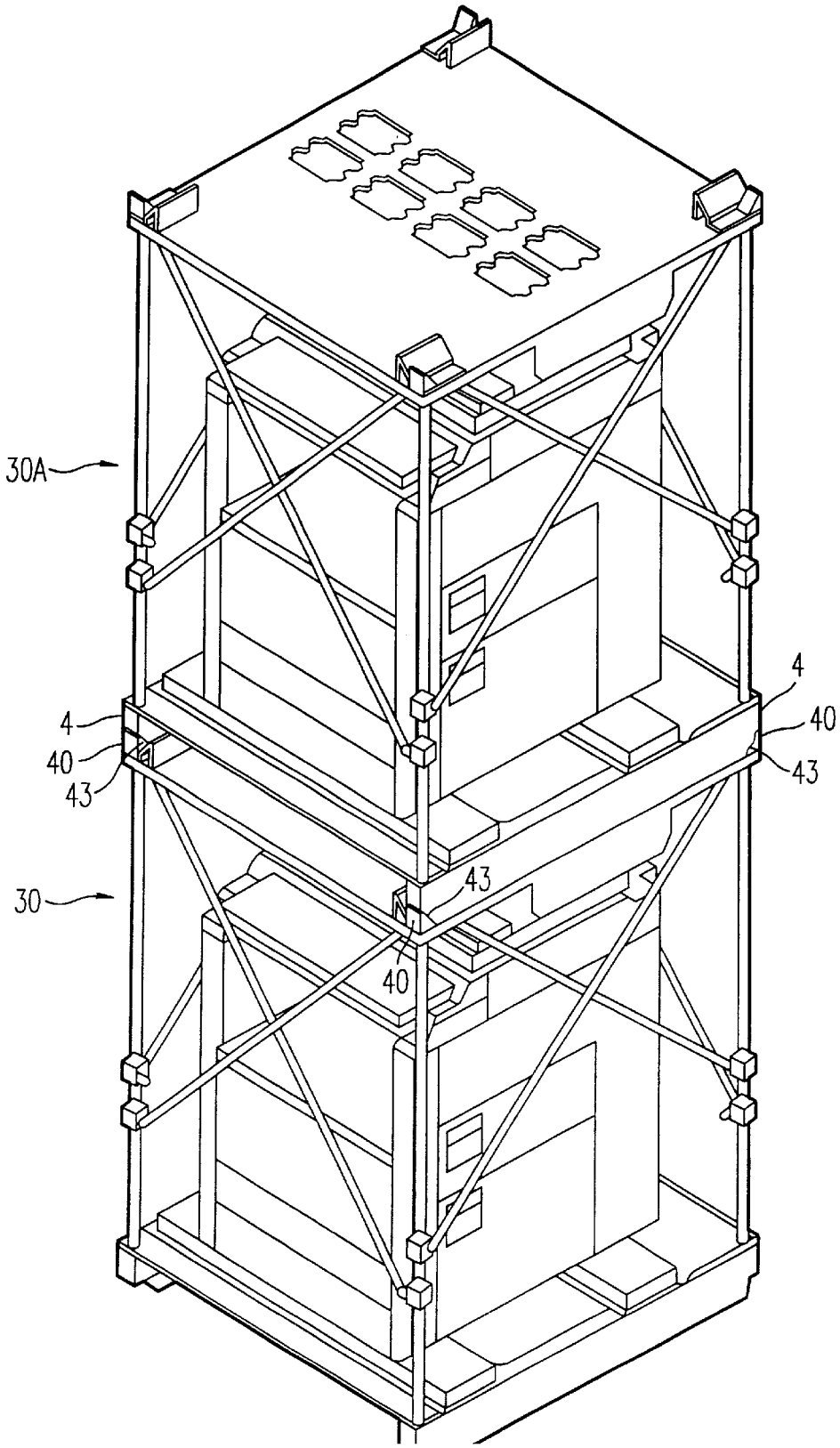
FIG. 21 is a perspective view showing a state where the commodity carrying and storing apparatuses illustrated in FIG. 19 are stacked.

As shown in FIG. 20, when the upper commodity carrying and storing apparatus 30A is lowered from above the lower commodity carrying and storing apparatus 30 and is placed on the lower commodity carrying and storing apparatus 30 as shown in FIG. 21, the upper commodity carrying and storing apparatus 30A is positioned while being guided by the inclined faces 38 of the guiding members 34A to 34D shown in FIGS. 19 and 20 in one of the horizontal directions H1 in the manner similar to the case of the commodity carrying and storing apparatus shown in FIGS. 1 to 16.

In the example shown in FIGS. 19 to 21, also when the position of the upper commodity carrying and storing apparatus 30A which is lowered is deviated from the lower commodity carrying and storing apparatus 30 in the other horizontal direction H2 (FIG. 20) which is orthogonal to the one of the horizontal direction H1, the ends in the longitudinal direction of the legs 4 of the upper commodity carrying and storing apparatus 30A are guided along the guide faces as the inclined faces 41 of the guide pieces 40. Finally, as shown in FIG. 21, the legs 4 of the upper commodity carrying and storing apparatus 30A are placed on the base parts 28 (FIG. 19). At this time, the notches 43 of the legs 4 are engaged with the guide pieces 40, so that the upper commodity carrying and storing apparatus 30A is positioned to the lower commodity carrying and storing apparatus 30.

As described above, in the example, the upper commodity carrying and storing apparatus 30A can be accurately positioned on the lower commodity carrying and storing apparatus 30 while being guided not only in one of the horizontal directions H1 but also in the other horizontal direction H2 which is orthogonal to the direction H1. Thus, the upper commodity carrying and storing apparatus 30A can be more easily guided and positioned. In the example, the upper commodity carrying and storing apparatus 30A can be positioned to the lower commodity carrying and storing apparatus 30 only by the guiding members 34 without fitting the upper ends of the columns 6 of the lower commodity carrying and storing apparatus 30 into the engagement holes formed in the legs 4 of the upper commodity carrying and storing apparatus 30A. In such a manner, the positioning of the upper commodity carrying and storing apparatus 30A can be easily performed.

The guiding members 34 shown in FIGS. 19 to 21 and the components related to the guiding members 34 can be applied to the commodity carrying and storing apparatus of the first form shown in FIGS. 1 to 6.

As described above, when a plurality of commodity carrying and storing apparatuses are stacked, the guiding members 34 of the commodity carrying and storing apparatus shown in FIGS. 1 to 16 and FIGS. 19 to 21 serve as an example of the guiding means for guiding the upper commodity carrying and storing apparatus 30A to the predetermined placement position of the lower commodity carrying and storing apparatus 30. The guiding means is provided for the top plate 33.

As described above, each of the guiding means also serves as apparatus positioning means for positioning the upper commodity carrying and storing apparatus 30A to the lower commodity carrying and storing apparatus 30 when the upper commodity carrying and storing apparatus 30A is placed on the lower commodity carrying and storing apparatus 30. It is therefore unnecessary to separately provide the guiding means and the apparatus positioning means, so that the construction of the commodity carrying and storing apparatus can be simplified.

The guiding means in the example shown in FIGS. 7 to 16 has a guiding face for guiding the upper commodity carrying and storing apparatus 30A in one of the horizontal directions H1 when the upper commodity carrying and storing apparatus 30A is lowered from above the lower commodity carrying and storing apparatus 30 and is placed onto the lower commodity carrying and storing apparatus 30. The guiding means in the example shown in FIGS. 19 to 21 has a guiding face for guiding the upper commodity carrying and storing apparatus 30A in the other horizontal direction H2 which is orthogonal to the one of the horizontal directions H1 when the upper commodity carrying and storing apparatus 30A is lowered from above the lower commodity carrying and storing apparatus 30 and is placed onto the lower commodity carrying and storing apparatus 30. The guide faces are formed as the inclined faces 38 and 41 for guiding the pallet of the upper commodity carrying and storing apparatus 30A. With the construction, the guiding faces can be easily constructed.

When the commodity carrying and storing apparatus in any of the forms is not in use, the top plate 33 is detached from the columns 6, the columns 6 are detached from the pallet 2, and the top plate 33 is placed on the pallet 2, thereby forming an assembly of the pallet 2 and the top plate 33. By stacking a plurality of top plate and pallet assemblies, the pallets 2 and the top plates 33 can be compactly collected and carried or stored.

Figure 17:
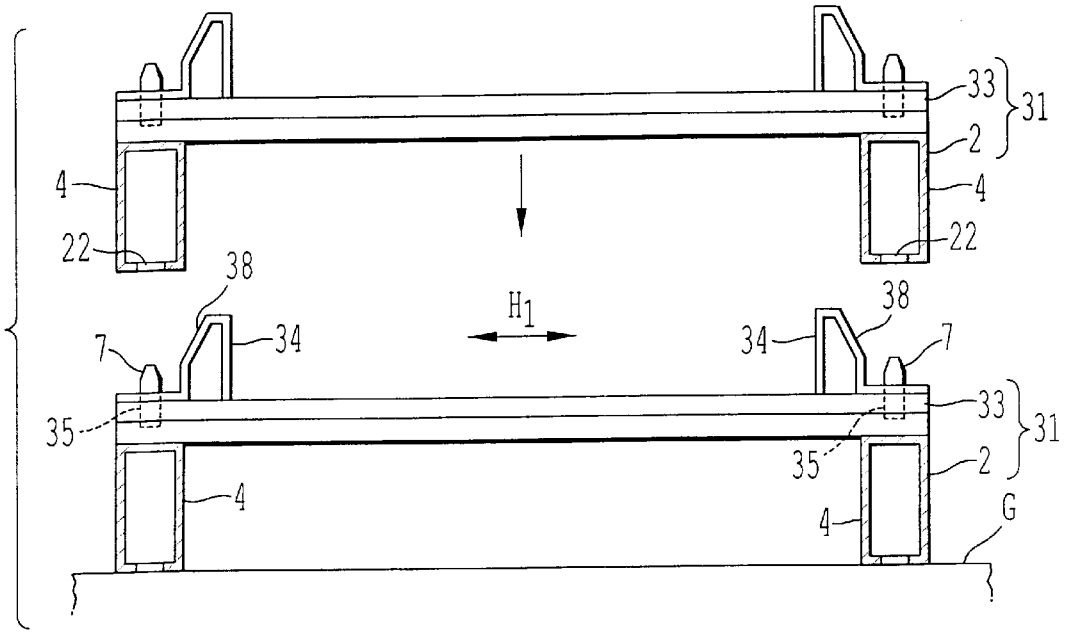
FIG. 17 is an explanatory diagram showing a state of assembling an upper top plate and pallet assembly to a lower top plate and pallet assembly.
Figure 18:
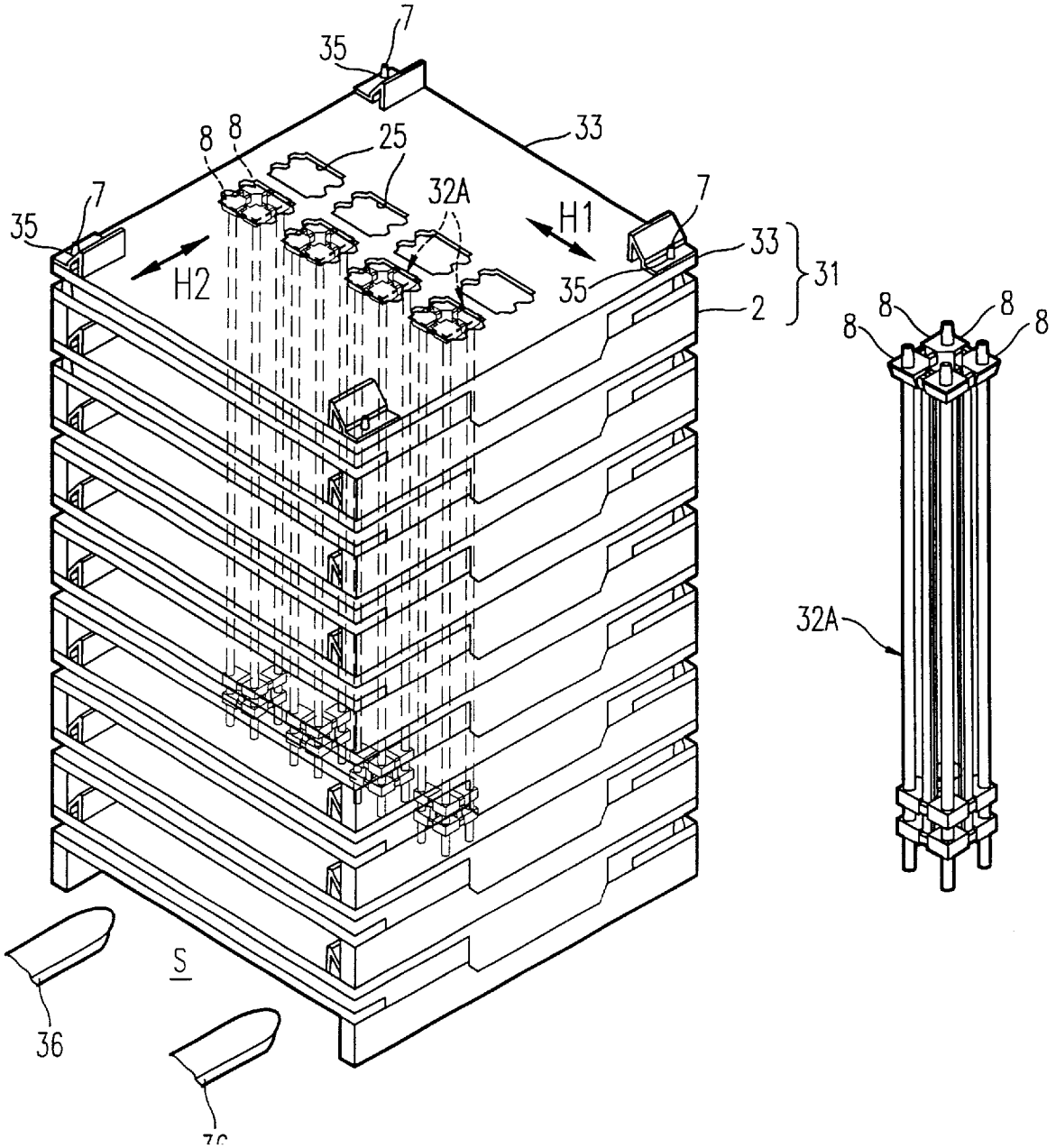
FIG. 18 is a perspective view showing a state where a number of top plate and pallet assemblies are stacked.
Figure 22:
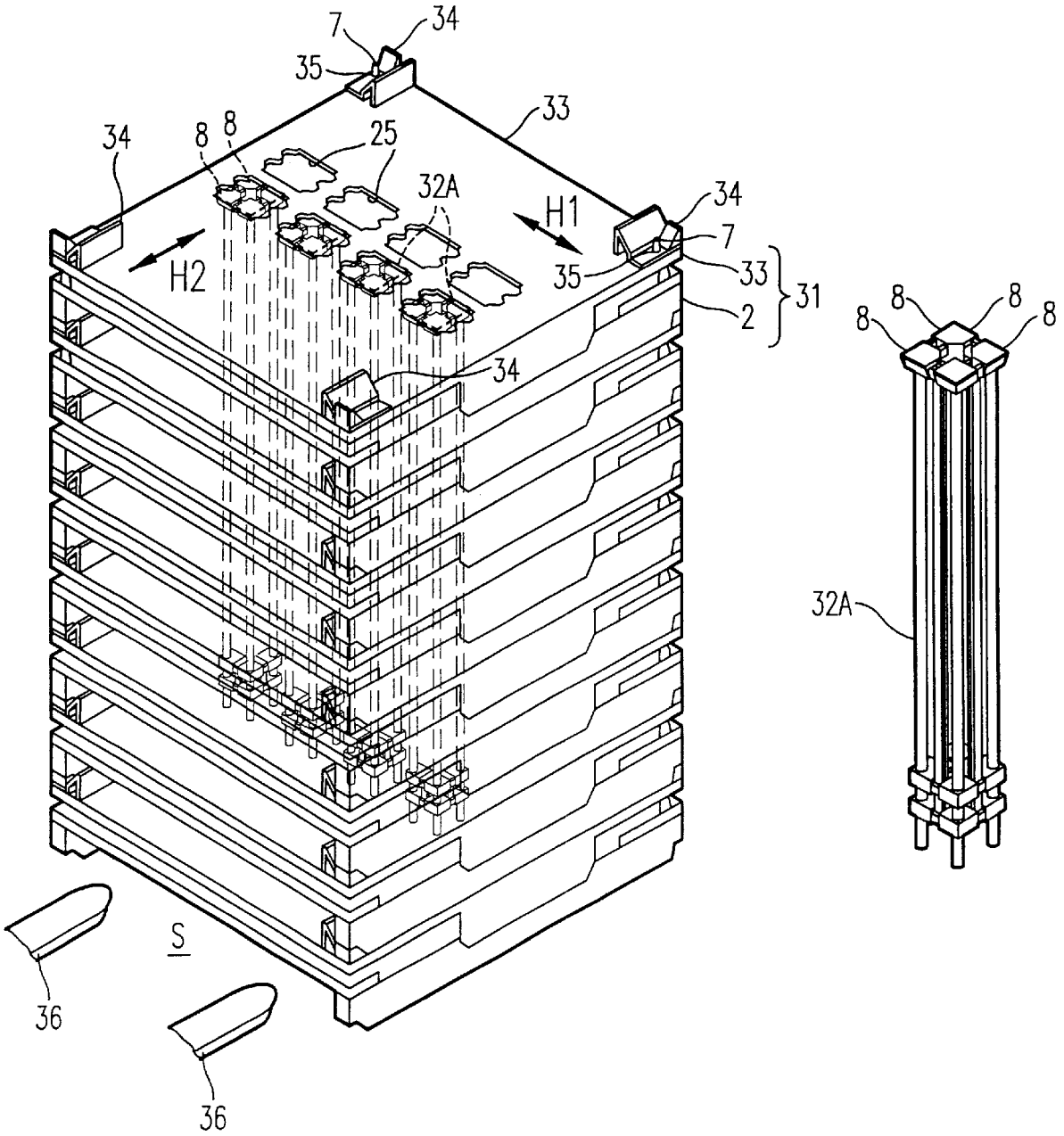
FIG. 22 is a perspective view showing a state where top plate and pallet assemblies each comprising a top plate and a pallet in the commodity carrying and storing apparatus illustrated in FIG. 19 are stacked.

FIG. 17 shows a state that the top plate 33 is placed on the pallet 2 of the commodity carrying and storing apparatus 30 shown in FIGS. 1 to 16, thereby obtaining a top plate and pallet assembly 31, the top plate and pallet assembly 31 is placed on a placement face G such as floor face, another top plate and pallet assembly 31 is lowered from above and is stacked on the lower top plate and pallet assembly 31. FIG. 18 shows a state where eight top plate and pallet assemblies 31 shown in FIG. 17 are stacked. Further, FIG. 22 shows a state where eight top plate and pallet assemblies 31 in each of which the pallet 2 and the top plate 33 in the commodity carrying and storing apparatus 30 shown in FIG. 19 are assembled are stacked.

As described above, in the case where the top plate 33 is placed on the pallet 2 and the top plate 33 and the pallet 2 are assembled as the top plate and pallet assembly 31, if the top plate 33 and the pallet 2 are largely deviated relative to each other in the horizontal direction, the top plate and pallet assembly 31 is not easily carried and stored.

The commodity carrying and storing apparatus of the example, consequently, has top plate positioning means for positioning the top plate 33 to the pallet 2 so that the top plate 33 and the pallet 2 construct the integral top plate and pallet assembly 31 when the top plate 33 is detached from the columns 6, the columns 6 are detached from the pallet 2 and, after that, the top plate 33 is placed on the pallet 2. In the example shown in the diagram, as clearly shown in FIG. 17, the top plate positioning means is constructed by the projections 7 provided for the pallet 2 and the holes 35 formed in the top plate 33. As shown in FIG. 17, when the top plate 33 is placed on the pallet 2, the projections 7 of the pallet 2 are fit in the holes 35 formed in the top plate 33 and the guiding members 34, thereby checking the inconvenience such that the pallet 2 and the top plate 33 are largely deviated relative to each other in the horizontal direction. In the commodity carrying and storing apparatus shown in the diagram, the top plate positioning means is constructed by the projections 7 provided for the pallet 2 and the holes 35 which are formed in the top plate 33 to be placed on the pallet 2 and in which the projections 7 are fit.

As shown in FIG. 17, when the upper top plate and pallet assembly 31 is placed on the lower top plate and pallet assembly 31, the inclined faces 38 of the guiding members 34 fixed to the top plate 33 of the lower top plate and pallet assembly 31 are used to guide the legs 4 of the pallet 2 of the upper top plate and pallet assembly 31 in one of the horizontal directions H1 as described with reference to FIGS. 15 and 16. When the upper top plate and pallet assembly 31 is placed on the lower top plate and pallet assembly 31, by the guide members 34, the upper top plate and pallet assembly 31 is positioned to the lower top plate and pallet assembly 31 in one of the horizontal directions H1. At this time, the projections 7 of the lower top plate and pallet assembly 31 are fit in the engagement holes 22 which are long holes formed in the legs 4 of the upper top plate and pallet assembly 31. The upper top plate and pallet assembly 31 is positioned to the lower top plate and pallet assembly 31 in the other horizontal direction H2 which is orthogonal to the one of the horizontal directions H1.

When the top plate and pallet assemblies 31 each made by the pallet 2 and the top plate 33 shown in FIG. 19 are stacked as shown in FIG. 22, the guiding members 34 of the lower top plate and pallet assembly 31 guide the upper top plate and pallet assembly 31 in both one of the horizontal directions H1 and the other horizontal direction H2 and position the upper top plate and pallet assembly 31 to the lower top plate and pallet assembly 31 in both of the horizontal directions H1 and H2. In this case, each of the engagement holes formed in the legs 4 of the commodity carrying and storing apparatus 30 shown in FIGS. 19 and 20 is formed much larger than the projection 7. When the projection 7 is fit in the engagement hole, the upper and lower top plate and pallet assemblies 31 are not positioned by the engagement hole and the projection 7. Only the guiding members 34 shown in FIGS. 19 and 20 guide and position the upper and lower top plate and pallet assemblies 31 in both of the horizontal directions H1 and H2. Consequently, when the upper top plate and pallet assembly 31 is stacked on the lower top plate and pallet assembly 31, the worker does not have to intentionally fit the projections 7 and the engagement holes. The upper and lower top plate and pallet assemblies 31 can be automatically positioned and the projections 7 can be automatically loosely fit in the engagement holes. Thus, the work efficiency can be increased.

As described above, in the commodity carrying and storing apparatus in any of the forms, after the top plate 33 is detached from the columns 6 and the columns 6 are detached from the pallet 2, the top plate 33 is placed on the pallet 2 to thereby form the top plate and pallet assembly 31 of the top plate 33 and the pallet 2. When the upper and lower top plate and pallet assemblies 31 are stacked, the guiding means guides the upper top plate and pallet assembly 31 to the lower top plate and pallet assembly 31. Moreover, when the upper top plate and pallet assembly 31 is placed on the lower top plate and pallet assembly 31, the guiding means positions the upper top plate and pallet assembly 31 to the lower top plate and pallet assembly 31.

As shown in FIGS. 18 and 22, by stacking the plurality of top plate and pallet assemblies 31, they can be efficiently carried or stored in a small space. Since each of the foldable column units 32 and 32A is constructed by the plurality (four in the example of the diagram) of columns 6 and the coupling means, it can be also compactly carried or stored. For example, when the commodities 1 are placed on a number of commodity carrying and storing apparatuses and transported in a lump from a certain place to another place, the top plate 33 is detached from the columns 6, the column units 32 and 32A are detached from the pallets 2, each of the commodities 1 is unloaded from the pallet 2, and the top plate 33, pallet 2 and the column units 32 and 32A are returned to the original place, the top plate 33 and the pallet 2 are formed as the top plate and pallet assembly 31. By stacking a plurality of assemblies 31 and folding the column units 32 and 32A, they can be carried to the original place and can be stored compactly.

When a number of folded column units 32 and 32A and a number of top plate and pallet assemblies 31 are carried separately or stored, however, the top plate and pallet assemblies 31 and the column units 32 and 32A occupy a large space.

In the commodity carrying and storing apparatus of the example, therefore, the folded column units 32 and 32A can be housed in the stacked top plate and pallet assemblies 31. To be specific, as shown in FIGS. 2, 8 and 19, openings 24 are formed in the pallet 2 and, further, openings 25 are formed in the top plate 33 as well. When the top plate and pallet assembly 31 is formed by assembling the pallet 2 and the top plate 33 and a plurality of top plate pallet assemblies 31 are stacked as shown in FIGS. 18 and 22, storage spaces for storing the column units 32 and 32A are formed by the openings 24 and 25. The column unit 32A shown by solid lines in FIGS. 18 and 22 is inserted to the storage space from the opening 25 formed on the uppermost top plate as shown by broken lines. In such a manner, a number of top plate and pallet assemblies 31 and a number of column units 32A can be carried or stored in a lump more compactly. Although the column unit 32A is shown in FIGS. 18 and 22, the column unit 32 illustrated in FIG. 6 can be also stored in the storage space in the same manner.

As described above, in the commodity carrying and storing apparatus shown in the diagram, the openings 24 and 25 are formed in the pallet 2 and the top plate 33 so as to form the spaces for storing the folded column units 32 and 32A when a plurality of top plate and pallet assemblies 31 are stacked.

In the commodity carrying and storing apparatus shown in FIGS. 18 and 22, a part of the column unit 32A, that is, the four first joints 8 in the example of the diagram are formed larger than the openings 25 formed in the top plate 33. In the case of housing the column unit 32A in the storing space, the largely formed part in the column unit, that is, the four first joints 8 can be engaged with the rim of the opening 25 formed in the top plate 33 of the uppermost top plate and pallet assembly 31. With the construction, the column unit 32A housed in the storing space can be checked from being dropped from the space. A number of top plate and pallet assemblies 31 and a number of column units 32A can be efficiently carried or stored. The column unit 32 shown in FIG. 6 can be constructed in the same manner.

As shown in FIGS. 18 and 22, a cargo gear such as the fork 36 of the fork lift truck is inserted under the lowest pallet 2 of the number of top plate and pallet assemblies 31 stacked, and the number of top plate and pallet assemblies 31 and the column units 32A housed in the top plate and pallet assemblies 31 can be carried. The pallet 2 is constructed so that a space S (FIGS. 18 and 22) to which the cargo gear such as the fork of the fork lift truck is inserted is formed below the commodity placement face 5 (FIGS. 2, 8 and 19).

As shown by broken lines in FIGS. 18 and 22, at the time of storing the column unit 32A in the storing space in the number of top plate and pallet assemblies 31, if the lower part of the column unit 32A exists in the space S of the pallet 2 of the lowest top plate and pallet assembly 31, when the fork 36 is inserted into the space S, the fork 36 collides with the lower part of the column unit 32A. It is therefore necessary to determine the number of top plate and pallet assemblies 31 to be stacked so that the column unit 32A does not exist in the space S of the lowest pallet 2. It is, however, troublesome for the worker to perform the work while determining the number of the top plate and pallet assemblies 31 to be stacked, so that the work efficiency deteriorates.

In the example shown in FIGS. 18 and 22, the plurality of openings 25 are formed in the top plate 33. The length of the column unit 32A is set so that the column unit 32A does not exist in the space S below the commodity placement face of the pallet 2 in the lowest top plate pallet assembly 31 when the top plate and pallet assemblies 31 of the number equal to the number of openings 25 are stacked and the column units 32A are inserted to the openings 25 formed in the top plate 33 of the uppermost top plate and pallet assembly 31.

In the example of FIGS. 18 and 22, eight openings 25 are formed in the top plate 33. The worker therefore stacks eight top plate and pallet assemblies 31 of which number is equal to the number of openings 25. In such a state, the eight column units 32A corresponding to the top plate and pallet assemblies 31 are inserted into the storing spaces from the respective openings 25 formed in the uppermost top plate 33. At this time, the column unit 32A does not exist in the space S in the lowest pallet 2. Consequently, the fork 36 can be inserted to the space S without a hitch and the top plate and pallet assemblies 31 and the column units 32A can be carried. As described above, the worker can efficiently carry out the work without considering anything special. The construction can be also applied to the case where the column unit 32 shown in FIG. 6 is used.

As shown in FIGS. 2, 8 and 19, a display part 44 in which desired information is written is provided for the top plate 33. In the example shown in the diagrams, the display part 44 is constructed by a tongue part which extends downward from the periphery of the top plate 33.

In the display part 44 provided for the top plate 33, proper information in characters, figure, or the like, for example, the product name or serial number of the commodity 1 to be carried or stored by the commodity carrying and storing apparatus, the serial number of the commodity, the serial number of the commodity carrying and storing apparatus, a handling method of the commodity carrying and storing apparatus such as an assembling method or disassembling method of the commodity carrying and storing apparatus can be written. By the information, the handling person can easily handle the commodity carrying and storing apparatus. The display part can be provided for not only one of the peripheries of the top plate 33 but also the other peripheries. Information can be directly written on the display part or a resin sheet, a paper label, or the like on which information is written may be adhered to the display part.

Although the representative embodiments of the invention have been described above, the invention is not limited to the constructions of the embodiments but can be variously modified. The invention can be widely applied to an apparatus which carries or stores substantially anything such as various products besides a copying machine or natural products.

According to the invention, commodities of various sizes can be carried or stored. When an upper commodity carrying and storing apparatus is placed on a lower commodity carrying and storing apparatus, the upper commodity carrying and storing apparatus can be extremely easily placed on the lower commodity carrying and storing apparatus.

According to the invention, the upper commodity carrying and storing apparatus can be also accurately positioned to the lower commodity carrying and storing apparatus by the guiding means. The work of stacking the upper commodity carrying and storing apparatus can be more easily performed.

Further, according to the invention, the upper commodity carrying and storing apparatus can be placed on the lower commodity carrying and storing apparatus while accurately guiding the upper commodity carrying and storing apparatus to the lower commodity carrying and storing apparatus in one of the horizontal directions.

According to the invention, the upper commodity carrying and storing apparatus can be guided to the lower commodity carrying and storing apparatus not only in one of the horizontal directions but also in the other horizontal direction which is orthogonal to the one of the horizontal directions. Thus, the upper commodity carrying and storing apparatus can be more easily placed on the lower commodity carrying and storing apparatus.

According to the invention, the guiding face for guiding the upper commodity carrying and storing apparatus can be easily constructed.

According to the invention, the top plate and the pallet are assembled and the assembly can be easily and stably carried or stored.

According to the invention, the top plate positioning means of a simple structure can be constructed.

According to the invention, when a plurality of top plate and pallet assemblies each in which the top plate and the pallet are assembled are stacked, the work can be easily performed.

According to the invention, a plurality of top plate and pallet assemblies each in which the top plate and the pallet are assembled can be certainly and stably stacked.

According to the invention, the columns, pallet, and top plate which are collected compactly can be carried or stored.

According to the invention, the column unit can be certainly stored in the stacked top plate and pallet assemblies without being dropped.

According to the invention, when a plurality of top plate and pallet assemblies are stacked and column units are housed in the assemblies, a space into which a cargo gear can be inserted with reliability can be assured under the lowest pallet.

According to the invention, by providing the display part in which desired information is written, handling of the commodity carrying and storing apparatus can be facilitated.

Further, according to the invention, the display part can be formed without being bulky and an inconvenience that the display part is obstructive can be checked.

According to the invention, the distance between neighboring columns can be adjusted with a simple construction.

Particularly, according to the invention, the degree of freedom in adjusting the distance between neighboring columns can be increased.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A commodity carrying and storing apparatus comprising:

an upper commodity carrying and storing apparatus unit and a lower commodity carrying and storing apparatus unit, wherein each of the upper and lower commodity carrying and storing apparatus units include:

a pallet on which a commodity is placed;

a plurality of columns detachably attached to the pallet in positions so as to surround the commodity placed on the pallet;

a plurality of coupling units, wherein each coupling unit couples two adjacent columns of the plurality of columns, while adjusting a distance between the two adjacent columns of the plurality of columns;

a top plate detachably attached directly or via another member onto the plurality of columns; and a plurality of guiding units, wherein each guiding unit is positioned on top of the top plate so as to guide the upper commodity carrying and storing apparatus unit to a predetermined placement position with respect to the lower commodity carrying and storing apparatus unit when the upper and lower commodity carrying and storing apparatus units are stacked.

2. The apparatus according to claim 1, wherein each guiding unit of the plurality of guiding units also serves as an apparatus positioning unit which positions the upper commodity carrying and storing apparatus unit with respect to the lower commodity carrying and storing apparatus unit when the upper commodity carrying and storing apparatus unit is placed on the lower commodity carrying and storing apparatus unit.

3. The apparatus according to claim 1, wherein each guiding unit of the plurality of guiding units has a guide face for guiding the upper commodity carrying and storing apparatus unit in a first of left and right horizontal directions when the upper commodity carrying and storing apparatus unit is lowered from above onto the lower commodity carrying and storing apparatus unit to be positioned on the lower commodity carrying and storing apparatus unit.

4. The apparatus according to claim 3, wherein the guide face of each guiding unit of the plurality of guiding units is constructed as an inclined face which guides the pallet of the upper commodity carrying and storing apparatus unit.

5. The apparatus according to claim 3, wherein each guiding unit of the plurality of guiding units has a guide face which guides the upper commodity carrying and storing apparatus unit in a second of the left and right horizontal directions which is orthogonal to the first of the left and right horizontal directions when the upper commodity carrying and storing apparatus unit is lowered from above onto the lower commodity carrying and storing apparatus unit to be positioned on the lower carrying and storing apparatus unit.

6. The apparatus according to claim 5, wherein the guide face of each guiding unit of the plurality of guiding units is constructed as an inclined face which guides the pallet of the upper commodity carrying and storing apparatus unit.

7. An apparatus according to claim 1, further comprising a top plate positioning unit which positions the top plate to the pallet so as to construct a top plate and pallet assembly in which the top plate and the pallet are assembled when the top plate is detached from the columns, the columns are detached from the pallet, and the top plate is placed on the pallet.

8. An apparatus according to claim 7, wherein the plurality of columns and coupling unit construct a column unit which can be folded in a state where the columns are detached from the pallet, and openings are formed in the pallet and the top plate so that when a plurality of top plate and pallet assemblies are stacked, a space for storing the folded column unit is formed on the inside.

9. An apparatus according to claim 8, wherein a part of the column unit is formed larger than the opening formed in the top plate, and the largely formed column unit part in the column unit can be engaged with the periphery of the opening formed in the top plate.

10. An apparatus according to claim 9, wherein the pallet is constructed so that a space in which a cargo gear is inserted is formed below a commodity placement face, a plurality of openings are formed in the top plate, and the length of the column unit is set so that the column unit does not exist in the space below the commodity placement face of the pallet in the lowest top plate and pallet assembly when top plate and pallet assemblies of the number equal to the number of openings are stacked and the column unit is inserted to each of the openings formed in the top plate of the uppermost top plate and pallet assembly.

11. An apparatus according to claim 7, wherein the top plate positioning unit comprises a projection provided for the pallet and a hole which is formed in the top plate to be placed on the pallet and in which the projection is fit.

12. An apparatus according to claim 11, wherein the plurality of columns and coupling unit construct a column unit which can be folded in a state where the columns are detached from the pallet, and openings are formed in the pallet and the top plate so that when a plurality of top plate and pallet assemblies are stacked, a space for storing the folded column unit is formed on the inside.

13. An apparatus according to claim 12, wherein a part of the column unit is formed larger than the opening formed in the top plate, and the largely formed column unit part in the column unit can be engaged with the periphery of the opening formed in the top plate.

14. An apparatus according to claim 13, wherein the pallet is constructed so that a space in which a cargo gear is inserted is formed below a commodity placement face, a plurality of openings are formed in the top plate, and the length of the column unit is set so that the column unit does not exist in the space below the commodity placement face of the pallet in the lowest top plate and pallet assembly when top plate and pallet assemblies of the number equal to the number of openings are stacked and the column unit is inserted to each of the openings formed in the top plate of the uppermost top plate and pallet assembly.

15. An apparatus according to claim 1, wherein when the top plate is detached from the columns, the columns are detached from the pallet, the top plate is placed on the pallet, the top plate and the pallet are assembled as a top plate and pallet assembly, and upper and lower top plate and pallet assemblies are stacked, the guiding unit guides the upper top plate and pallet assembly to the lower top plate and pallet assembly.

16. An apparatus according to claim 15, wherein the plurality of columns and coupling unit construct a column unit which can be folded in a state where the columns are detached from the pallet, and openings are formed in the pallet and the top plate so that when a plurality of top plate and pallet assemblies are stacked, a space for storing the folded column unit is formed on the inside.

17. An apparatus according to claim 16, wherein a part of the column unit is formed larger than the opening formed in the top plate, and the largely formed column unit part in the column unit can be engaged with the periphery of the opening formed in the top plate.

18. An apparatus according to claim 17, wherein the pallet is constructed so that a space in which a cargo gear is inserted is formed below a commodity placement face, a plurality of openings are formed in the top plate, and the length of the column unit is set so that the column unit does not exist in the space below the commodity placement face of the pallet in the lowest top plate and pallet assembly when top plate and pallet assemblies of the number equal to the number of openings are stacked and the column unit is inserted to each of the openings formed in the top plate of the uppermost top plate and pallet assembly.

19. An apparatus according to claim 1, wherein when an upper top plate and pallet assembly is placed on a lower top plate and pallet assembly, the guiding unit positions the upper top plate and pallet assembly to the lower top plate and pallet assembly.

20. An apparatus according to claim 19, wherein the plurality of columns and coupling unit construct a column unit which can be folded in a state where the columns are detached from the pallet, and openings are formed in the pallet and the top plate so that when a plurality of top plate and pallet assemblies are stacked, a space for storing the folded column unit is formed on the inside.

21. An apparatus according to claim 20, wherein a part of the column unit is formed larger than the opening formed in the top plate, and the largely formed column unit part in the column unit can be engaged with the periphery of the opening formed in the top plate.

22. An apparatus according to claim 21, wherein the pallet is constructed so that a space in which a cargo gear is inserted is formed below a commodity placement face, a plurality of openings are formed in the top plate, and the length of the column unit is set so that the column unit does not exist in the space below the commodity placement face of the pallet in the lowest top plate and pallet assembly when top plate and pallet assemblies of the number equal to the number of openings are stacked and the column unit is inserted to each of the openings formed in the top plate of the uppermost top plate and pallet assembly.

23. An apparatus according to claim 1, wherein a display part in which desired information is written is provided for the top plate.

24. An apparatus according to claim 23, wherein the display part is a tongue part which extends downward from the periphery of the top plate.

25. An apparatus according to claim 1, wherein four columns detachably attached to the pallet so as to be almost perpendicular to a commodity placement face of the pallet are provided, and the coupling unit interlockingly adjusts so that distances each between two neighboring columns change at the same ratio.

26. An apparatus according to claim 1, wherein four columns detachably attached to the pallet so as to be almost perpendicular to a commodity placement face of the pallet are provided, and the coupling unit interlockingly adjusts a distance between two neighboring columns and a distance between other two neighboring columns which face the above two columns so that the distances change at the same ratio.

27. An apparatus according to claim 1, wherein four columns which are detachably attached to the pallet so as to be almost perpendicularly to a commodity placement face of the pallet are provided, the coupling unit has first and second joints attached to each column along the longitudinal direction of the column and first and second coupling members for coupling two neighboring columns to each other, the second joint is positioned lower than the first joint in a state where the four columns are attached to the pallet, the first and second coupling members are positioned so as to cross each other in a state where the four columns are attached to the pallet, one end in the longitudinal direction of each of the first coupling members is turnably coupled to the first joint attached to one of neighboring columns, the other end in the longitudinal direction is turnably coupled to the second joint attached to the other column in the two neighboring columns, one end in the longitudinal direction of each of the second coupling members is turnably coupled to the first joint attached to the other column, the other end in the longitudinal direction is turnably coupled to the second joint attached to the one of the columns, and at least one of the first and second joints is assembled to each of the columns so as to be movable in the longitudinal direction of the column.

28. An apparatus according to claim 1, wherein first to fourth columns detachably attached to the pallet almost so as to be perpendicular to a commodity placement face of the pallet are provided; the coupling unit has first to third joints attached to each of first to fourth columns along the longitudinal direction of the column and first and second coupling members for coupling neighboring first and second columns, neighboring second and third columns, neighboring third and fourth columns, and neighboring fourth and first columns; the second and third joints are positioned lower than the first joint and the second joint is positioned lower than the third joint in a state where the four columns are attached to the pallet; the first and second coupling members are positioned so as to cross each other in a state where the four columns are attached to the pallet; one end in the longitudinal direction of each of the first and second coupling members provided between the first and second neighboring columns and the first and second coupling members provided between the third and fourth columns positioned opposite to the first and second columns is turnably coupled to the first joint attached to each of the first to fourth columns, and the other end in the longitudinal direction is turnably coupled to the second joint attached to each of the first to fourth columns; one end in the longitudinal direction of each of the first and second coupling members provided between the neighboring second third columns and the first and second coupling members provided between the fourth and first columns which are positioned opposite to the second and third columns is turnably coupled to the first joint attached to each of the second, third, fourth and first columns, and the other end in the longitudinal direction is turnably coupled to the third joint attached to each of the second, third, fourth and first columns; and at least the second and third joints in the first to third joints are assembled to each of the attached columns so as to be movable in the longitudinal direction of the column.

* * * * *